US008310166B2

(12) United States Patent
Nagaoka

(10) Patent No.: US 8,310,166 B2
(45) Date of Patent: Nov. 13, 2012

(54) LIGHTING DEVICE AND LIGHTING FIXTURE USING THE SAME

(75) Inventor: Shinichi Nagaoka, Tsubame (JP)

(73) Assignee: Panasonic Corporation, Osaka (JP)

( * ) Notice: Subject to any disclaimer, the term of this patent is extended or adjusted under 35 U.S.C. 154(b) by 330 days.

(21) Appl. No.: 12/742,688

(22) PCT Filed: Nov. 14, 2008

(86) PCT No.: PCT/JP2008/070795

§ 371 (c)(1),
(2), (4) Date: May 13, 2010

(87) PCT Pub. No.: WO2009/063984

PCT Pub. Date: May 22, 2009

(65) Prior Publication Data

US 2010/0264831 A1 Oct. 21, 2010

(30) Foreign Application Priority Data

Nov. 14, 2007 (JP) ..... 2007-295827
Nov. 14, 2007 (JP) ..... 2007-295828

(51) Int. Cl.
*H05B 37/02* (2006.01)

(52) U.S. Cl. ..... 315/209 R; 315/308

(58) Field of Classification Search ..... 315/209 R, 315/276, 291, 307, 308
See application file for complete search history.

(56) References Cited

U.S. PATENT DOCUMENTS

| | | | | |
|---|---|---|---|---|
| 6,111,368 | A * | 8/2000 | Luchaco | 315/307 |
| 6,133,696 | A * | 10/2000 | Tavares et al. | 315/194 |
| 6,269,012 | B1 * | 7/2001 | Kusakabe et al. | 363/84 |
| 6,906,477 | B2 * | 6/2005 | Kazanov et al. | 315/294 |
| 2009/0236999 | A1 | 9/2009 | Yufuku et al. | |
| 2009/0289581 | A1 | 11/2009 | Matsuzaki et al. | |
| 2009/0315470 | A1 | 12/2009 | Kumagai et al. | |
| 2010/0084988 | A1 | 4/2010 | Nagata et al. | |

FOREIGN PATENT DOCUMENTS

| | | |
|---|---|---|
| JP | 04-332497 | 11/1992 |
| JP | 11-111486 | 4/1999 |
| JP | 11-135290 | 5/1999 |
| JP | 2006-032033 | 2/2006 |
| JP | 2006-278009 | 10/2006 |

* cited by examiner

*Primary Examiner* — Thuy Vinh Tran
(74) *Attorney, Agent, or Firm* — Greemblum & Berstein, P.L.C.

(57) ABSTRACT

A lighting device receives an output of a power supply phase detector and performs a lighting control of a lighting load by a trigger signal to be output from a load controller to a switching element (a load drive unit) at an arbitrary conduction angle. The load controller includes a determination unit that turns on the switching element at a phase of a conduction angle of a commercial power supply in which any lighting load (an incandescent lamp, a bulb-type fluorescent lamp, and an LED lamp) can be turned on during a predetermined period after turning on a power supply, so as to determine a type of the lighting load during the period. The load controller switches to a predetermined operation mode depending on a type of the lighting load determined by the determination unit.

18 Claims, 25 Drawing Sheets

LIGHTING DEVICE AND LIGHTING FIXTURE USING THE SAME

TECHNICAL FIELD

The present invention relates to a lighting device using a resistive load such as an incandescent lamp, a capacitive load such as a bulb-type fluorescent lamp, an inductive load, and the like together as a lighting load, and relates to a lighting fixture using the lighting device.

BACKGROUND ART

Recently, a lighting fixture equipping a human body detection sensor for lighting by detecting a human and an illuminance sensor for performing a lighting control according to peripheral brightness has been prevailed outside a house and at a side surface of a house for the purpose of saving electricity and security (FIG. 1). Such a lighting fixture used except a living space usually employs incandescent lamps in combination, which are simpler and less expensive. However, the incandescent lamps have low energy conversion efficiency from electricity to light. In addition, light to be let in is turned on while saving electricity by dimming light when no one is present.

FIG. 2 illustrates a constitution example of a lighting fixture with a sensor having a function for dimming an incandescent lamp used at a side surface of a house. A lighting fixture 20 is composed of a translucent cover 21, a waterproof cover packing 22, a lamp fitting 23 and a flange 24 for supporting the cover 21 and packing 22, and a socket 25 for a lighting load 1. The flange 24 is provided with a lighting device therein for an on-off control of lighting. In addition, the flange 24 is provided with a sensor unit 26 protruded therefrom at a lower portion equipped with an infrared sensor for turning on the lighting load 1 by detecting a movement of a human and an illuminance sensor for a lighting control according to peripheral illuminance, thereby reading changes of lighting into a load controller inside the lighting device.

For example, when a value read by the illuminance sensor corresponds to brightness in the daytime, the lighting load is configured to be in an off state regardless of a presence of a human, and when peripheral illuminance becomes arbitrary darkness, the incandescent lamp is controlled to dim with 30% of brightness. Furthermore, when the infrared sensor detects a movement of a human while dimming with 30% of brightness, the incandescent lamp is controlled to light with 100% of brightness. Furthermore, the lighting device has a function to turn off the lighting load again when determining that an arbitrary time has been passed and midnight has come, and to light the lighting load with 100% of brightness only when someone is present.

FIG. 3 illustrates a constitution example of a dimming-control circuit using a switching element used for such a lighting fixture. FIG. 4 illustrates a specific circuit example of FIG. 3. The circuit of FIG. 4, of which a specific explanation will be described later in an explanation of FIG. 12, is configured that a load controller 5 outputs a trigger signal at a predetermined phase angle based on a power supply phase signal detected by a power supply phase detector 4, and a load drive unit 3 configured with a switching element such as a TRIAC element TR is phase-controlled, so as to drive the lighting load 1 by a commercial ac power supply AC.

Operations of the load controller 5 and the load drive unit 3 in an on state of the TRIAC element TR are described with reference to FIG. 5. The load controller 5 normally maintains an output to the load drive unit 3 at an H-level during a condition that the lighting load 1 is not turned on. When the TRIAC element TR is turned on, i.e. the lighting load 1 is turned on, a trigger waveform is configured to be a pulsed L-level from a timing after a predetermined phase period T1 (e.g. 9 milliseconds) since a timing when output of the power supply phase detector 4 is converted from an H-level into an L-level, to a timing after a pulse period T2 (e.g. 500 microseconds). Thus, a transistor Q2 of the load drive unit 3 is turned on, and the TRIAC element TR is turned on by applying a trigger current. Immediately after turning on, the lighting load 1 composed of the incandescent lamp as a resistive load is applied with a sine-wave current.

As a result, it is possible to perform the dimming-control by controlling the period T1 and the period T2 by the load controller 5. For example, an effective value of an input current of the incandescent lamp as a resistive lighting load is to be proportionally increased by gradually shortening the period T1 and prolonging the period T2. Therefore, the lighting load is turned on by controlling brightness from 0% toward 100%.

In addition, FIG. 6 illustrates a constitution example of the dimming-control circuit additionally provided with a sensor function. Note that, fundamental operations with regard to lighting of the lighting load are as described above. The load controller 5, to which a sensor unit 7 is connected, determines how and when the lighting load 1 should be turned on according to e.g. logical disjunction/logical conjunction of each sensor signal obtained from a lighting condition setting portion and the sensor unit 7.

The lighting fixture used outside a house or at a side surface of a house has been used employing the lighting device equipped with the incandescent lamp in which the dimming-control can be performed such a resistive lighting load, and the switching element such as a TRIAC element, in combination with the sensor. While, in recent years requiring saving electricity, a lighting fixture using a fluorescent lamp with higher energy conversion efficiency and longer life compared with the incandescent lamp has been increasingly used. Actually, in such a situation, a lighting load such as a bulb-type fluorescent lamp (refer to FIG. 36) that is configured to have a similar size and shape to the incandescent lamp and can be directly attached to a socket for the incandescent lamp has been developed. For example, PTL 1 and 2 disclose lighting devices in which such a bulb-type fluorescent lamp is phase-controlled.

However, when the dimming-controlled resistive load (such as the incandescent lamp) is directly replaced to the capacitive load (such as the bulb-type fluorescent lamp) and then the above-mentioned phase control is performed, there is a problem of the bulb-type fluorescent lamp that is not lighted although the incandescent lamp is lighted, and also a problem of a gap in a lighting start time between the incandescent lamp and the bulb-type fluorescent lamp, at performing the dimming-control. This is because of a property of the capacitive load such as the bulb-type fluorescent lamp in which an input current is not applied, i.e. the lamp is not lighted, until an input voltage reaches a certain level, while the incandescent lamp is applied with an input current in proportion to an input voltage.

FIG. 7 illustrates a basic constitution example of the bulb-type fluorescent lamp represented by the capacitive load. The constitution example includes a rectifier at power supply input portions, which is composed of a diode bridge DB or the like, and an electrolytic capacitor Ci for smoothing a rectified output of the rectifier. The also includes an inverter IV for lighting a fluorescent lamp FL by energy stored in the electrolytic capacitor Ci. A relationship between an input voltage and an input current has a waveform illustrated in FIG. 8. The input current is to be applied when voltage Vci of both terminals of the electrolytic capacitor Ci reaches to a predetermined voltage (refer to PTL 1).

FIG. 9 illustrates a relationship between the input voltage and a lighting condition when a lighting control of the capacitive load such as the bulb-type fluorescent lamp is performed in the above-mentioned lighting device for performing the dimming-control to the resistive load. A trigger signal in this figure has a waveform in the case where the lamp is lighted by the dimming-control so as to increase the amount of light from 0% to 100% if this is the case of the incandescent lamp. With regard to a position of a trailing edge where the trigger signal is changed from an H-level to an L-level, a phase of the power supply voltage is shifted from an "f" point (approximately)180° to an "e" point (0° side). The bulb-type fluorescent lamp cannot be lighted after applied with the trigger signal even if the trigger signal is applied at a trailing edge where a current is not applied to the bulb-type fluorescent lamp, i.e. the power supply voltage is low. The lamp is not lighted until the trailing edge phase of the trigger signal is shifted to a voltage position ("g" point) where the bulb-type fluorescent lamp can be lighted due to the dimming-control.

Due to such a phenomenon, when, for example, it is assumed that the bulb-type fluorescent lamp can be lighted at the phase 70° and the trailing edge phase of the trigger signal is automatically shifted at intervals of 2° degrees, the lamp is to be lighted after 35 cycles of 8.3 ms, i.e. the lamp is lighted after a delay of approximately 0.3 seconds even if the phase is shifted by every half cycle of the input voltage of a 60 Hz cycle (120 Hz). In this case, a lighting fixture with an infrared sensor, for example, is lighted after a human moves through a distance of 1.5 m even if the trigger signal is applied by detecting the human when it is assumed that the human moves at 5 m/s. As a result, a user feels a lighting delay of the bulb-type fluorescent lamp compared with the incandescent lamp.

Actually, the inverter IV instantly operates when the trigger signal is applied at a phase where the voltage Vci is higher than a predetermined voltage in a phase of more than 90° of a power supply voltage according to a relationship between the electrolytic capacitor Ci and the input voltage. However, the electrolytic capacitor Ci is not charged and a flickering phenomenon may be caused since the voltage Vci is immediately reduced. Therefore, for example, in a case of a mode of keeping lighting by dimming light at a certain level, the incandescent lamp is lighted by dimming light. However, the bulb-type fluorescent lamp may cause a repeated flickering phenomenon.

Thus, troubles due to such a load difference have been dealt with generally by being configured that each lighting device has its own control method, or by being configured that a selector switch is provided so as to select a load that a user uses. However, when employing such measures, there are problems of a regulated arrangement of the lighting device inside the fixture and complexity of the constitution of the lighting device caused by providing such a switch in the lighting device. Moreover, the recent lighting load is hard to determine apparently whether the load is a resistive load or a capacitive load when an LED is employed for the lighting load, for example. Also, it is extremely difficult for a user to judge the difference.

The present invention has been made focusing on the above-described problems. An object of the present invention is to provide a lighting device and a lighting fixture for performing a lighting control of a lighting load by a switching element, in which a user can freely select a lighting load and does not need to intentionally set the lighting device corresponding to the selected lighting load, and a lighting control can be achieved according to each load characteristics.

Citation List

Patent Literature

[PTL 1] Japanese Patent Application Laid-Open Publication No. H11-135290 (published in 1999).

[PTL 2] Japanese Patent Application Laid-Open Publication No. H11-111486 (published in 1999).

SUMMARY OF INVENTION

To solve the above-mentioned problem, a lighting device according to the present invention includes: a switching element that turns on/off a commercial power supply supplied as a power supply for a lighting load, a power supply phase detector that detects a phase of the commercial power supply so as to perform a phase control for the lighting load, and a load controller that determines a conduction angle of the switching element by receiving an output of the power supply phase detector, in which a signal to be output at an arbitrary conduction angle to the switching element from the load controller performs a lighting control for the lighting load, wherein the lighting device switches operation modes depending on a type of the lighting load according to a result determined by a determination unit for determining a type of the lighting load by a signal from a load lighting detector for detecting whether the lighting load is turned on or not, during a predetermined period after turning on the power supply.

While a lighting fixture according to the present invention includes: the lighting device having the above-mentioned features; and a socket of an E-type cap for a lighting load.

DESCRIPTION OF EMBODIMENT

A description will be made below of embodiments of the present invention with reference to the drawings.

(Embodiment 1)

Figure 1:
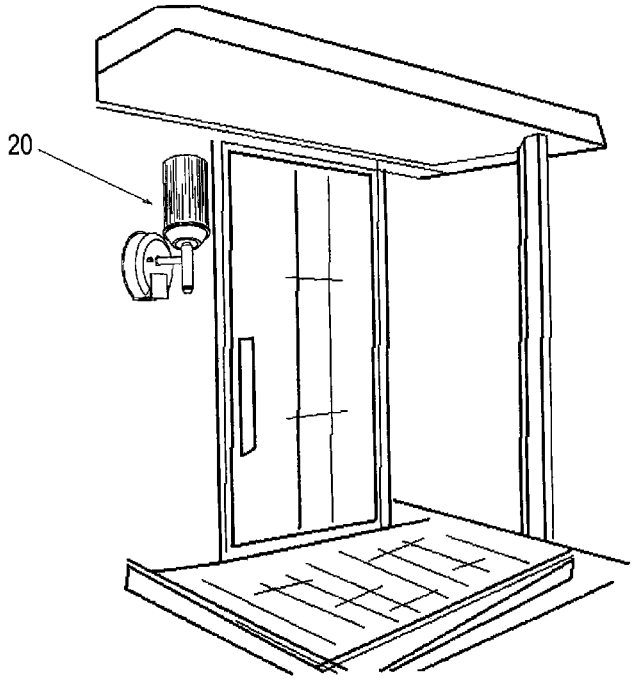
FIG. 1 PRIOR ART
FIG. 1 is a perspective view illustrating an appearance of a conventional lighting fixture used at a side surface of a house.
Figure 2:
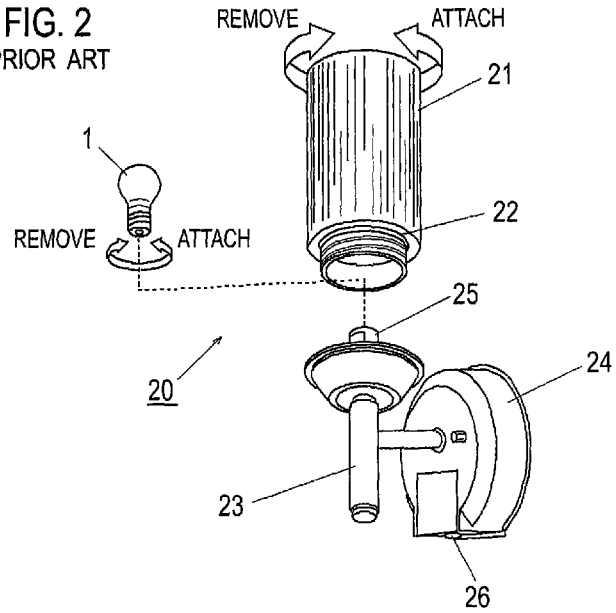
FIG. 2 PRIOR ART
FIG. 2 is an exploded perspective view illustrating a constitution example of a conventional lighting fixture with dimming-control type sensor for an incandescent lamp used at a side surface of a house.
Figure 3:
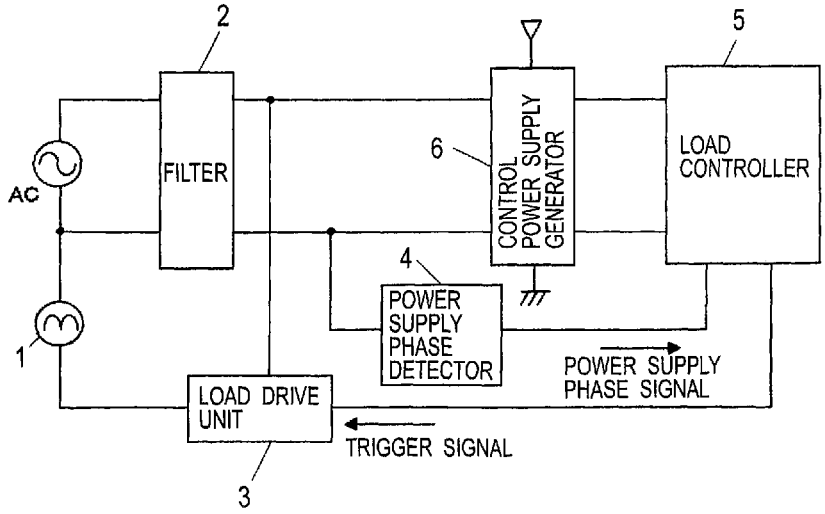
FIG. 3 PRIOR ART
FIG. 3 is a block diagram illustrating a constitution example of a conventional lighting device for a dimming-control of an incandescent lamp.
Figure 10:
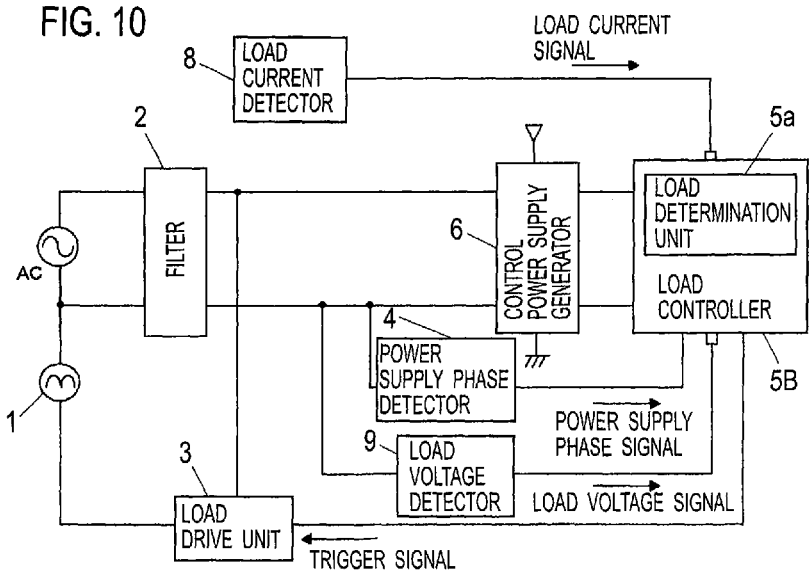
FIG. 10 is a block diagram illustrating a constitution of an embodiment 1 of the present invention.

FIG. 10 illustrates a constitution example of a lighting device of the present embodiment. The fundamental constitution and operation are the same as the conventional example of FIG. 3. In addition, the present embodiment is provided with a load current detector 8 for detecting a current of the lighting load 1 and a load voltage detector 9 for detecting a load voltage, each of which is connected so that each of detection signals is supplied to the load controller 5B that concurrently functions as a load determination unit 5*a*.

The reference numeral 1 represents the lighting load, which is composed of a resistive load such as a relatively small incandescent bulb provided with a reflective film for a light distribution by a vapor deposition of silver on the bulb. Alternatively, a capacitive load such as a bulb-type fluorescent lamp may be connected instead of the incandescent bulb.

The reference numeral 2 represents a filter, which is composed of a capacitor and a coil in order to remove a flow of high-frequency noise between the commercial ac power supply AC and the lighting device.

The reference numeral 3 represents the load drive unit, which is configured by using the switching element such as a TRIAC element in order to drive the lighting load 1 by receiving a trigger signal output from the load controller 5B.

The reference numeral 4 represents the power supply phase detector, which detects a power supply phase used as synchronous signal for a phase control of the lighting load 1.

The reference numeral 5 represents the load controller, which is composed of an IC such as a microcomputer in order to control an operation of the lighting load 1. The load controller concurrently functions as the load determination unit 5*a* that receives detection signals from the load current detector 8 and the load voltage detector 9 so as to determine a type of the load.

The reference numeral 6 represents a control power supply generator, which is composed of a diode, the capacitor, a Zener diode, and the like in order to rectify the commercial ac power supply AC so as to convert to a dc voltage.

A specific circuit example for each of portions is described later in the embodiment of FIG. 12.

Figure 11:
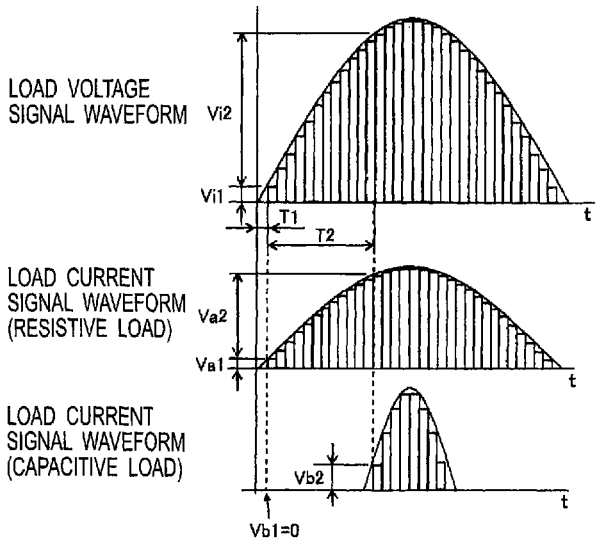
FIG. 11 is an operational waveform chart of the embodiment 1 of the present invention.

FIG. 11 illustrates waveforms of a load voltage signal and load current signals supplied to the load controller 5B. The load current signals in the figure represent a case of a resistive load and a case of a capacitive load. In the present embodiment, the trigger signal is applied so as to synchronize the load voltage signal and the load current signal based on the power supply phase signal.

The load controller 5B is composed of a microcomputer including an A/D conversion input port, which digitizes a fluctuating analog signal so that a load voltage value and a load current value are read at each arbitrary time interval T. For example, it is assumed that the load voltage signal has a value of Vi1 at time T1 and a value of Vi2 at time T2. Then, in the case of the resistive load, the load current signal is Va1 at time T1 and Va2 at time T2. Alternatively, in the case of the capacitive load, the load current signal is Vb1 at time T1 and Vb2 at time T2, however, Vb1 is 0, while Vb2 has a value that is not 0. Thus, it is possible to determine the type of the lighting load 1 by reading the waveform of each load current signal and relatively evaluating the signals.

For example, when the value of the load current signal is 0 in more than an arbitrary interval with respect to an interval in which the value of the load voltage signal is not 0, the lighting load is determined as a capacitive load. Alternatively, when the value of the load current signal has an approximately proportional relationship with respect to the value of the load voltage signal, the lighting load can be determined as a resistive load.

Meanwhile, when the value of the load current signal is consistently 0 even if the value of the load voltage signal is not 0, a load anomaly can be detected because the lighting load is determined to be in a no-load condition or in a load anomaly condition. In this case, the lighting signal may be stopped.

(Embodiment 2)

Figure 12:
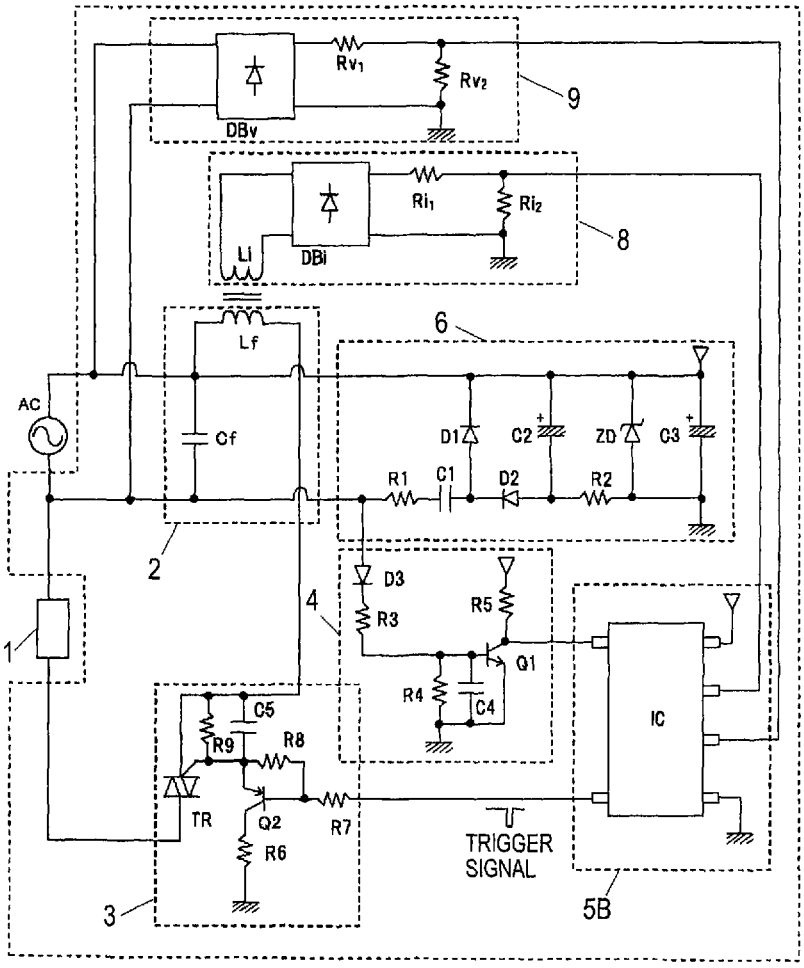
FIG. 12 is a circuit diagram illustrating a specific constitution of an embodiment 2 of the present invention.

FIG. 12 illustrates a circuit diagram of the present embodiment. The present embodiment is modified with regard to the load current detector 8 in the embodiment 1. The fundamental operation is the same as the embodiment 1. An operation of the load current detector 8 will be explained in this embodiment.

The load current detector 8 of the present embodiment employs the filter 2 used for removing a flow of high-frequency noise generated at a dimming-control of the lighting load 1. Specifically, an inductor Lf of the filter 2 is provided with a secondary winding Li having an electromagnetic coupling thereto. In addition, a voltage produced at the secondary winding Li is detected by dividing a voltage by resistors Ri1 and Ri2 after rectified by a diode bridge DBi.

By diverting the inductor Lf of the filter 2 to the load current detector 8, the number of components can be reduced compared with a case where a current transformer is separately provided for the current detection.

Note that, the load voltage detector 9 detects the power supply voltage of the commercial ac power supply AC as a load voltage. Similar to the load current detector 8, the load voltage detector 9 detects a voltage by dividing a voltage by resistors Rv1 and Rv2 after rectified at a diode bridge DBv.

Figure 4:
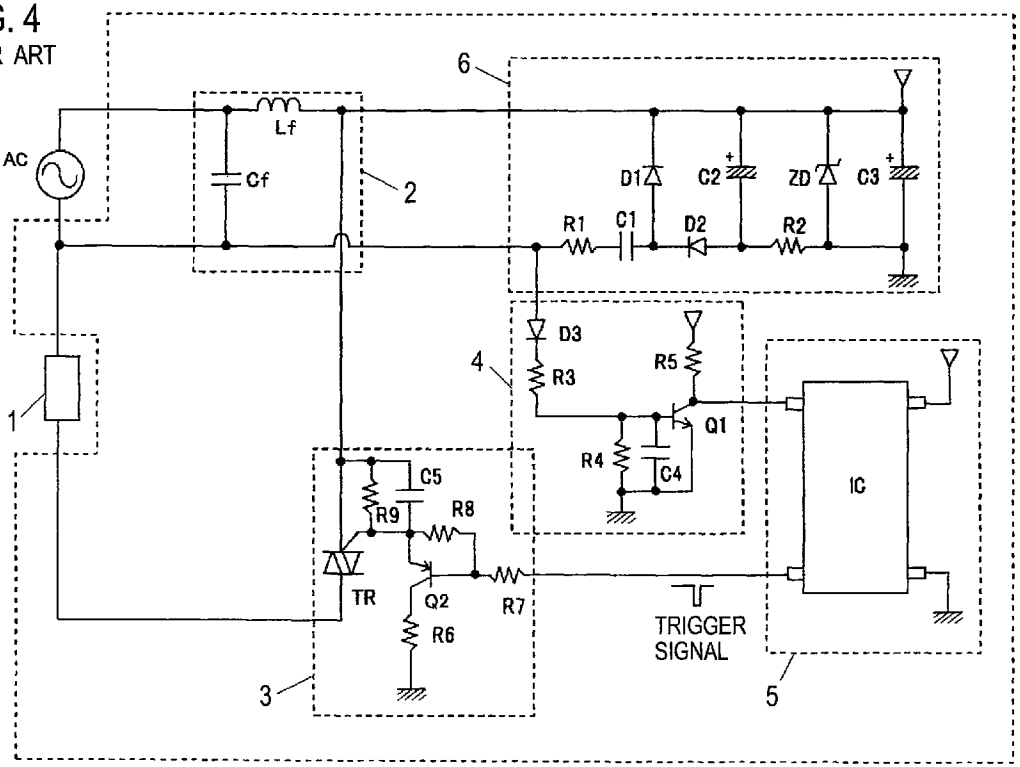
FIG. 4 PRIOR ART
FIG. 4 is a circuit diagram illustrating a specific circuit constitution of the conventional lighting device for the dimming-control of an incandescent lamp.

Next, a circuit constitution of each component in FIG. 12 will be explained. The following are similar explanations to the conventional example of FIG. 4.

The load drive unit 3 includes the TRIAC element TR inserted in a power feed path from the ac power supply AC to the lighting load 1, and a PNP-type transistor Q2 in which an emitter is connected to a gate of the TRIAC element TR and a collector is connected to a ground via a resistor R6. A base of the transistor Q2 is connected to the load controller 5B via a resistor R7, and connected to the emitter of the transistor Q2 via a resistor R8. In addition, a parallel circuit of a resistor R9 and a capacitor C5 is connected between one main electrode of the TRIAC element TR and the emitter of the transistor Q2.

The power supply phase detector 4 includes a rectifier diode D3 of which an anode is connected to the ac power supply AC, an NPN-type transistor Q1 of which a base is connected to a cathode of the rectifier diode D3 via a resistor R3, and a parallel circuit of a resistor R4 and a capacitor C4 connected between the base and an emitter of the transistor Q1. Namely, an output voltage of the ac power supply AC is rectified at the rectifier diode D3, divided by the resistors R3 and R4, smoothed at the capacitor C4 and input to the base of the transistor Q1. In addition, a collector of the transistor Q1 is connected to a dc power supply via a resistor R5, and a node of the resistor R5 and the transistor Q1 is connected to the IC of the load controller 5B. Thus, the output of the power supply phase detector 4 becomes an L-level by turning on the transistor Q1 when the output voltage of the ac power supply AC keeps above a predetermined voltage. Meanwhile, the output of the power supply phase detector 4 becomes an H-level by turning off the transistor Q1 when the input voltage falls below the predetermined voltage. Accordingly, the output is inverted at adjacent to the phase in which the voltage of the ac power supply AC becomes 0 V.

Figure 5:
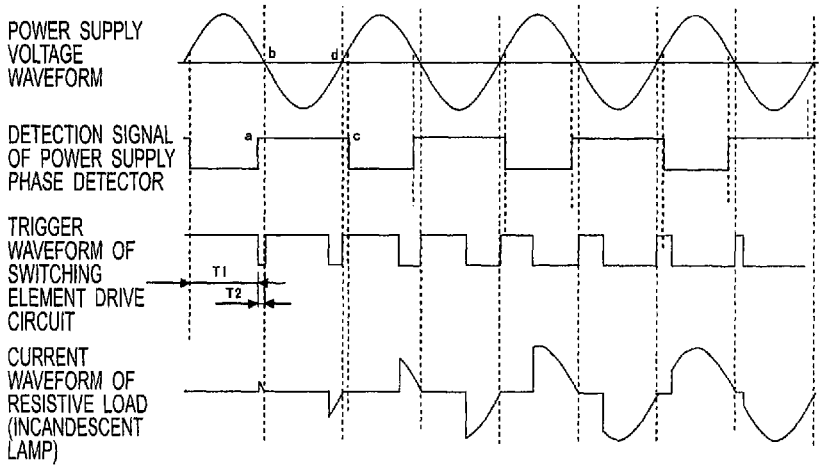
FIG. 5 PRIOR ART
FIG. 5 is an operational waveform chart when performing the dimming-control of an incandescent lamp in the conventional example.

As illustrated in the conventional example of FIG. 5, a timing "a" in which the output of the power supply phase detector 4 is shifted from the L-level to the H-level is slightly earlier than a timing "b" of the phase in which the corresponding voltage becomes 0 V. In addition, a timing "c" in which the output is shifted from the H-level to the L-level is slightly later than a timing "d" of the phase in which the corresponding voltage becomes 0 V.

The control power supply generator 6 includes a first resistor R1 for inhibiting an incoming current, of which both terminals are connected to the ac power supply AC, a series circuit of a first capacitor C1 composed of e.g. a film capacitor and a first diode D1, a series circuit of a second diode D2 and a second capacitor C2 connected to the first diode D1 in parallel, a series circuit of a second resistor R2 and a Zener diode ZD connected to the second capacitor C2 in parallel, and a third capacitor C3 connected to the Zener diode ZD in parallel.

An anode of the first diode D1 is connected to the first capacitor C1 and a cathode of the first diode D1 is connected to the ac power supply AC. An anode of the second diode D2 is connected to the second capacitor C2 and a cathode of the second diode D2 is connected to a node of the first diode D1 and the first capacitor C1. An anode of the Zener diode ZD is connected to the second resistor R2 and a cathode of the Zener diode ZD is connected to the same side as the first diode D1 with respect to the ac power supply AC. Namely, a control power supply voltage is generated by a Zener voltage of the Zener diode ZD.

Note that, the circuit constitution of the load drive unit 3, the power supply phase detector 4, and the control power supply generator 6 is an example constitution. Obviously, the other circuit constitution having a similar function may be replaced.

(Embodiment 3)

Figure 6:
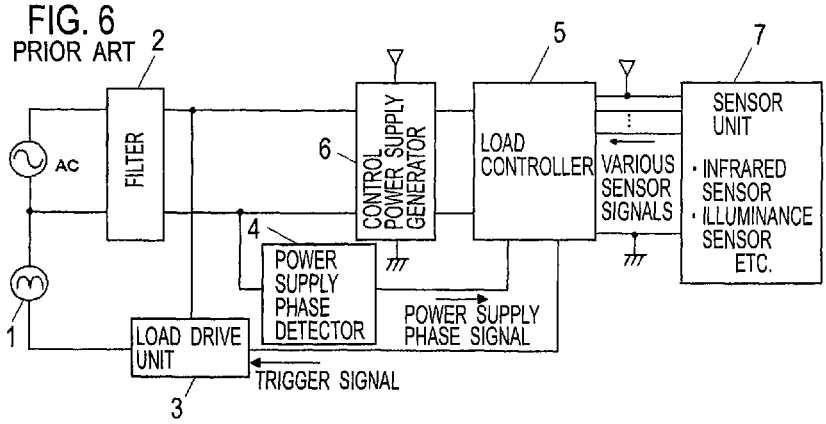
FIG. 6 PRIOR ART
FIG. 6 is a block diagram illustrating a constitution example of a conventional lighting device for a dimming-control of an incandescent lamp with a sensor.
Figure 13:
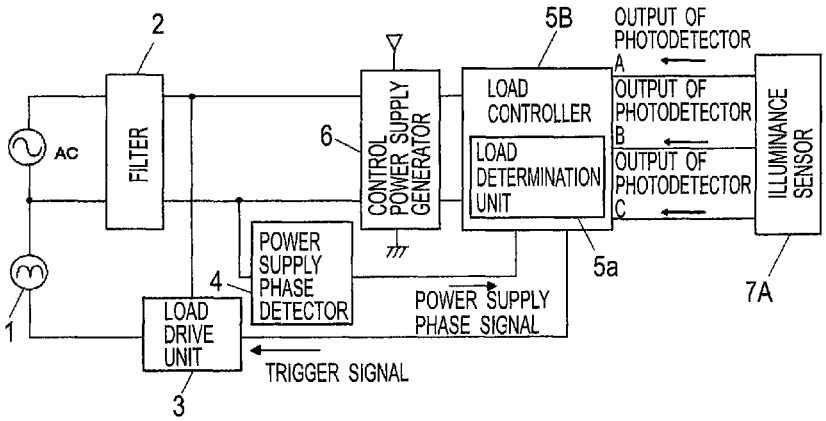
FIG. 13 is a block diagram illustrating a constitution of an embodiment 3 of the present invention.
Figure 14:
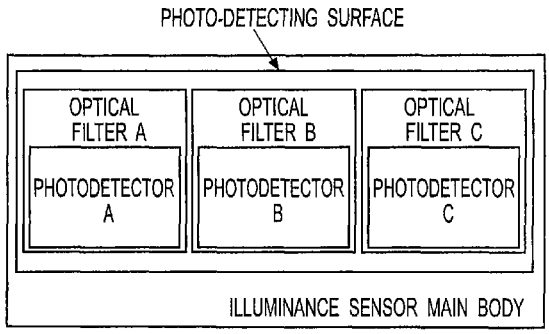
FIG. 14 is an explanatory diagram illustrating a schematic constitution of an illuminance sensor with optical filters used in a lighting device according to the embodiment 3 of the present invention.

FIG. 13 illustrates a constitution 5B example of a lighting device of the present embodiment. The fundamental constitution is the same as the conventional example of FIG. 6. In addition, an illuminance sensor 7A for determining a light output of the lighting load 1 is provided and connected to the load controller 5B that concurrently functions as the load determination unit 5*a*. In this case, the illuminance sensor 7A includes three sets of optical filters and photodetectors, each of the optical filters having a different transparent wavelength, provided inside a photo-detecting surface, as illustrated in FIG. 14. An output signal is output from each of the photodetectors.

Figure 15:
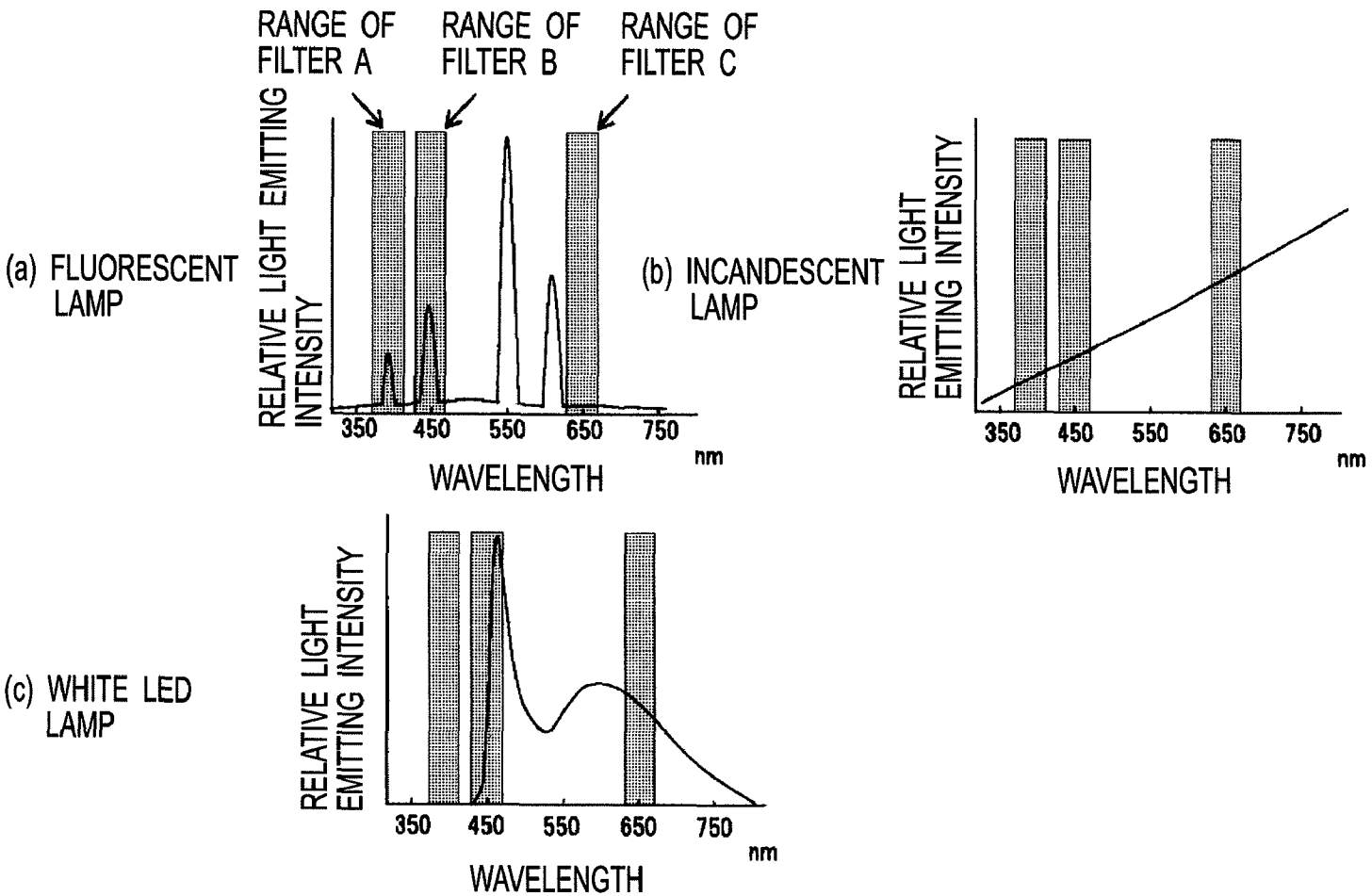
FIGS. 15(*a*) to (*c*) are diagrams illustrating spectroscopic characteristics of the optical filters used in the embodiment 3 of the present invention and spectral characteristics of lighting loads.

FIG. 15 is a diagram illustrating a relationship between a wavelength of a general output light and a relative light emitting intensity with regard to the respective fluorescent lamp, incandescent lamp, and white LED lamp. The white LED is composed of a blue diode and a yellow fluorescent body.

With regard to transparent characteristics of each of the optical filters illustrated in FIG. 14, it is assumed that a transparent wavelength range of an optical filter A is set between 380 and 420 nm, a transparent wavelength range of an optical filter B is set between 430 and 470 nm, and a transparent wavelength range of an optical filter C is set between 630 and 670 nm.

Figure 16:
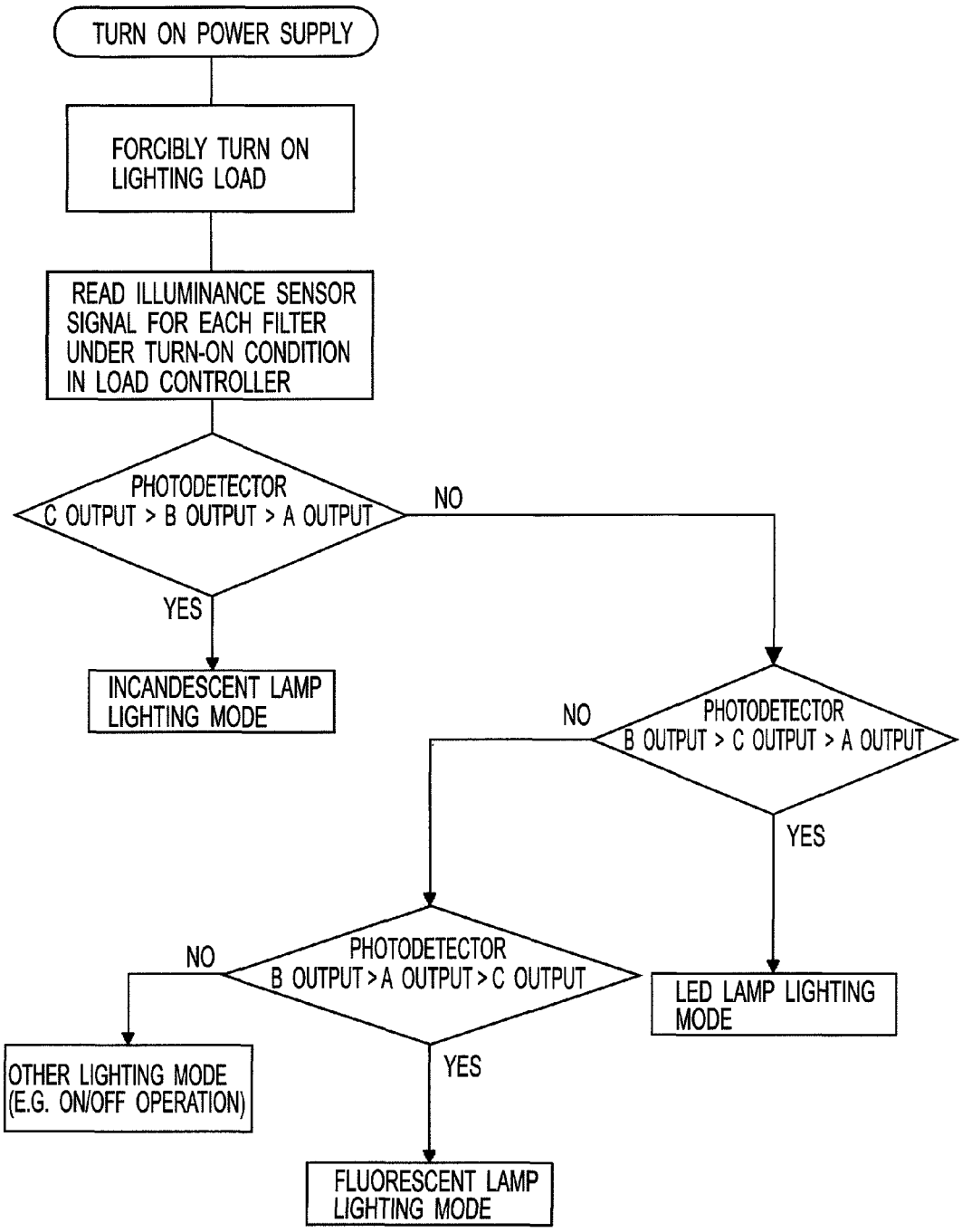
FIG. 16 is a flow chart illustrating an operation of a load determination by the illuminance sensor of the embodiment 3 of the present invention.

The load determination can be performed by processing a signal of each of the photodetectors to be input in the load controller 5B as illustrated in a flow chart in FIG. 16.

According to the relationship of the wavelengths in FIG. 15, the lighting load is determined as an incandescent lamp when the relative light emitting intensity adjacent to 630 to 670 nm is the highest. In addition, the lighting load is determined as a fluorescent lamp when the relative light emitting intensity adjacent to 380 to 420 nm is higher than the relative light emitting intensity adjacent to 630 to 670 nm. Moreover, the lighting load is determined as an LED lamp when the relative light emitting intensity adjacent to 430 to 470 nm is the highest.

Due to the determination of the lighting load type by the wavelength of the light output, it is possible to automatically select the lighting operation according to lighting load characteristics. For example, when the lighting load is determined as an incandescent lamp, the dimming-control operation may be performed. Alternatively, when the lighting load is determined as a fluorescent lamp, the load controller may automatically control blinking of the lighting load so as to reduce the number of blinking of the lighting load when, for example, the lighting load is used for the lighting fixture to perform a warning operation by blinking the lighting load. This is because the fluorescent lamp has a shorter blinking life compared with the other lighting loads.

Furthermore, by using the present embodiment in combination with the embodiment 1, it is possible to determine the lighting load more definitely since it is possible to determine whether the lighting load is a capacitive load or a resistive load even in LED light.

(Embodiment 4)

Figure 17:
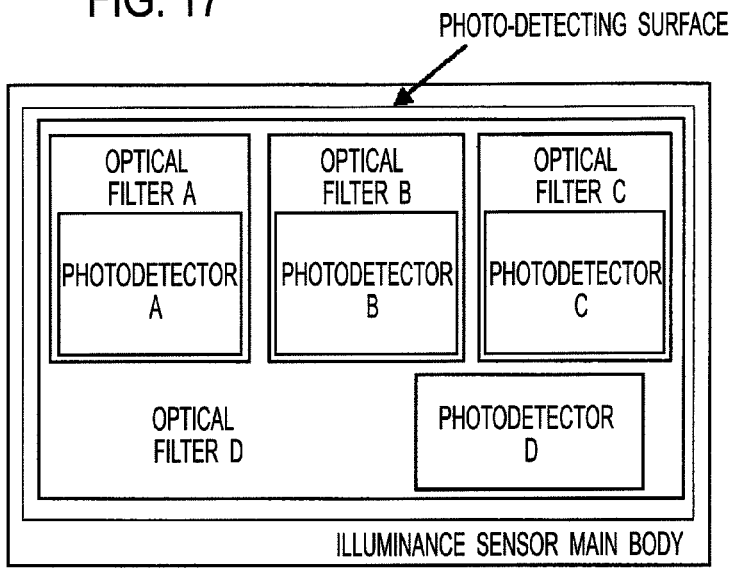
FIG. 17 is an explanatory diagram illustrating a schematic constitution of an illuminance sensor with optical filters used in a lighting device according to an embodiment 4 of the present invention.

In addition to the three sets of optical filter and photodetector of the illuminance sensor in the embodiment 3, the present embodiment is provided with an optical filter D and a photodetector D, of which a filter region is the whole visible light region covering the above-mentioned three sets of optical filter and photodetector. The constitution of the illuminance sensor is illustrated in FIG. 17.

Using a signal obtained from the photodetector D, a lighting control of the lighting load 1 is performed by reading a peripheral illuminance of the lighting fixture equipped with the lighting device and distinguishing brightness with respect to an arbitrarily set illuminance. The illuminance signal from the photodetector D and the operation of the lighting load will be explained with reference to FIG. 18.

Figure 18:
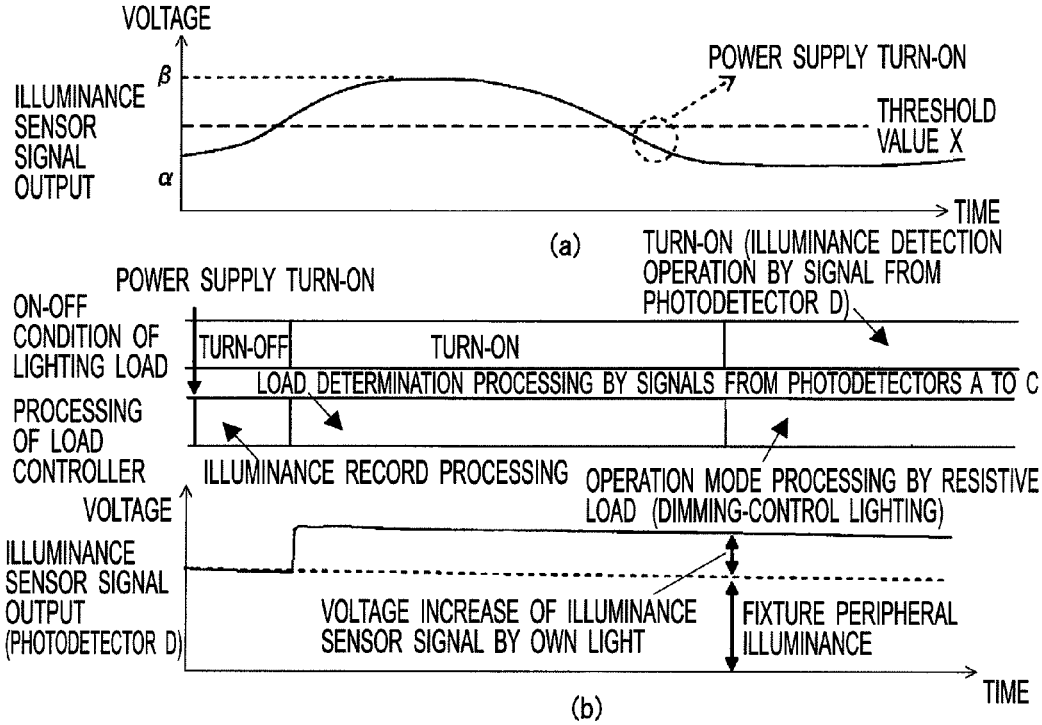
FIGS. 18(*a*) and (*b*) are operational explanatory views of the embodiment 4 of the present invention.

FIG. 18(*a*) illustrates a relationship between the signal of the illuminance sensor and the peripheral illuminance of the lighting fixture. An output signal waveform of the illuminance sensor continuously varies within an arbitrary range $\alpha$ to $\beta$ during a day. The illuminance sensor is composed of a photo IC diode, for example, and outputs a voltage signal with a higher voltage value as the periphery is brighter.

By arbitrarily setting a threshold value X with respect to the illuminance detection signal of the illuminance sensor in the load controller, it is possible to control the lighting load by turning off the lighting load when the signal level is above the threshold value X, and by turning on the lighting load when the signal level falls below the threshold value X. For example, by setting the threshold value X to a signal level of nightfall in the illuminance sensor, the lighting load can be automatically turned on at nightfall in every day. This embodiment performs determination processing of the lighting load in combination with such a lighting control.

Next, the determination process of the lighting load and the subsequent operation will be explained with reference to FIG. 18(*b*). It is assumed that the determination process of the lighting load is performed when the signal level falls below the arbitrarily set threshold value X.

First, the lighting load is turned on in the load determination process. However, the signal level of the photodetector D of the illuminance sensor is rapidly increased due to the lighting. If the signal level exceeds the threshold value X, the above-mentioned lighting control by use of the threshold value X by the illuminance sensor is influenced. In view of this situation, a result of the comparative determination of the signal level and the threshold value X by the photodetector D is not considered until the load determination process by the light output is completed. In addition, the peripheral illuminance just before lighting is stored in the load controller. Next, in the load determination process, signals of photodetectors A to C are detected to determine an operation mode of the lighting load, followed by confirming the illuminance by the signal of the photodetector D with respect to the threshold value level.

In this point, the signal level of the illuminance sensor may be increased by turning on the lighting load, and a phenomenon that the lighting load is turned off (self turn-on/off phenomenon) may be occurred by exceeding the threshold value level. However, the self turn-on/off phenomenon by its own light may be prevented after the load determination by performing mask processing, e.g. removing an influence on the sensor signal caused by the blinking of the lighting load. For example, a step in which the threshold value level after lighting is determined by adding an increased amount (a constant value independent of the peripheral illuminance) of the signal level after turning on the lighting load with respect to the illuminance level (threshold value level) before lighting may be employed.

Figure 19:
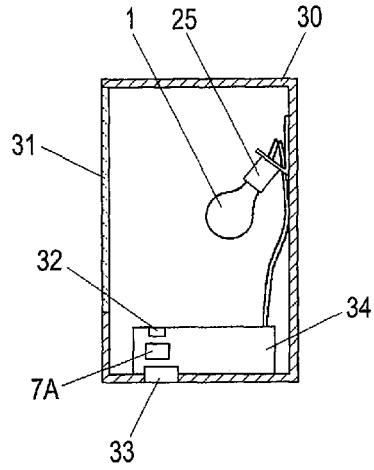
FIG. 19 is a cross-sectional view illustrating a schematic constitution of a lighting fixture equipped with the lighting device according to the embodiment 4 of the present invention.

FIG. 19 illustrates a constitution example of an actual lighting fixture. The lighting fixture is provided with the lighting load 1 and a lighting device 34 in a fixture housing 30 and a transparent glove 31 for transmitting light. Furthermore, an illuminance sensor 7A is equipped inside the lighting device 34. By providing a translucent window 32 located inside the lighting fixture in addition to a translucent window 33 provided in an outer flame of the fixture for transmitting peripheral light of the lighting fixture, the lighting fixture is configured to be able to detect light of the lighting load 1 itself.

Thus, by providing the illuminance sensor for the load determination concurrently having the function to determine the peripheral illuminance, the lighting fixture can concurrently function as a lighting fixture with an illuminance sensor.

(Embodiment 5)

Figure 20:
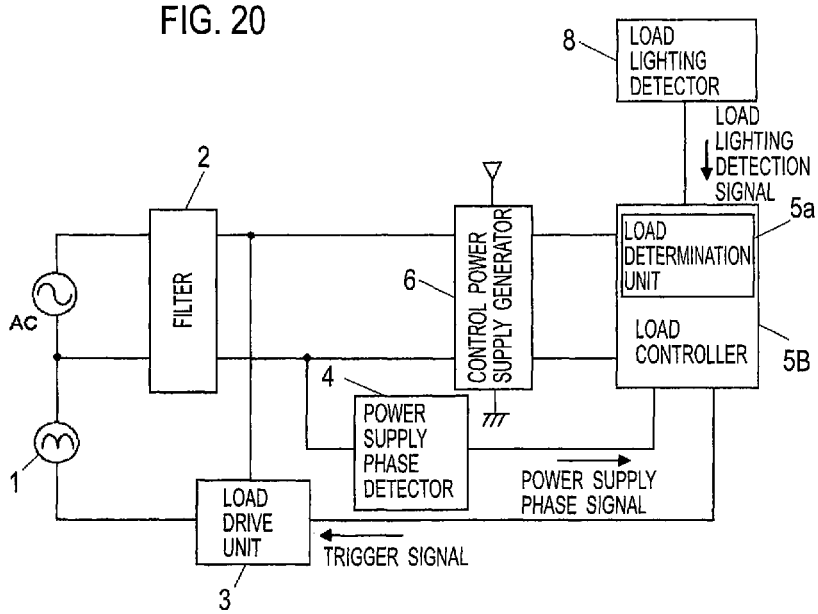
FIG. 20 is a block diagram illustrating a constitution of an embodiment 5 of the present invention.

FIG. 20 illustrates a constitution example of a lighting device of the present embodiment. The fundamental operation and constitution are the same as the conventional example of FIG. 3. The difference in the present embodiment is that the lighting device is provided with the load lighting detector 8 for determining whether the lighting load 1 is turned on, thereby inputting the detection signal to the load controller 5B.

The reference numeral 1 represents the lighting load, which is composed of a resistive load such as a relatively small incandescent bulb provided with a reflective film for a light distribution by a vapor deposition of silver on the bulb. Alternatively, a capacitive load such as a bulb-type fluorescent lamp may be connected instead of the incandescent bulb.

The reference numeral 2 represents the filter, which is composed of a capacitor and a coil in order to remove a flow of high-frequency noise between the commercial ac power supply AC and the lighting device.

The reference numeral 3 represents the load drive unit, which is configured by using the switching element such as a TRIAC element in order to drive the lighting load 1 by receiving a trigger signal output from the load controller 5B.

The reference numeral 4 represents the power supply phase detector, which detects a power supply phase used as synchronous signal for a phase control of the lighting load 1.

The reference numeral 5 represents the load controller, which is composed of an IC such as a microcomputer in order to control an operation of the lighting load 1. The load controller concurrently functions as the load determination unit 5*a* that receives a load lighting detection signal from the load lighting detector 8 so as to determine a load type.

The reference numeral 6 represents the control power supply generator, which is composed of a diode, a capacitor, a Zener diode, and the like in order to rectify the commercial ac power supply AC so as to convert to a dc voltage.

A specific circuit example for each component is described later in the embodiment of FIG. 27.

Figure 21:
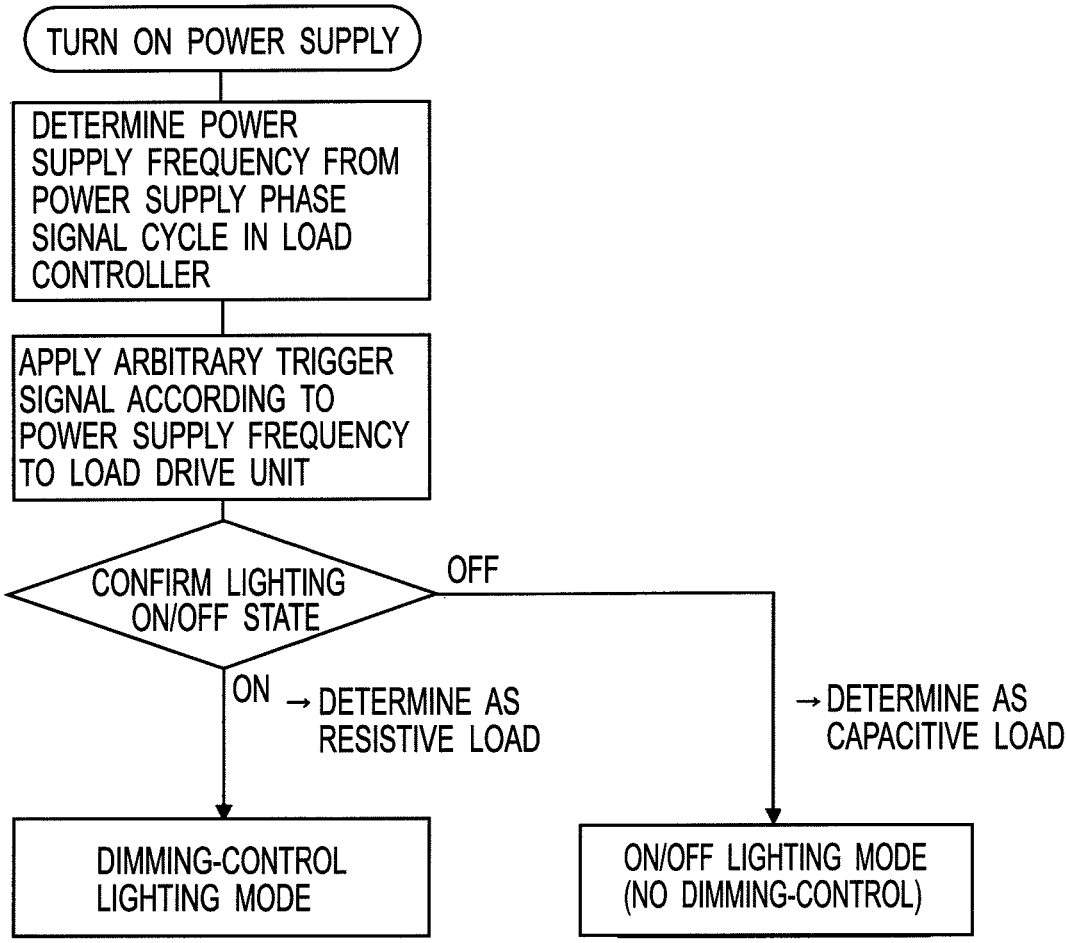
FIG. 21 is a flow chart illustrating an operation of the embodiment 5 of the present invention.
Figure 22:
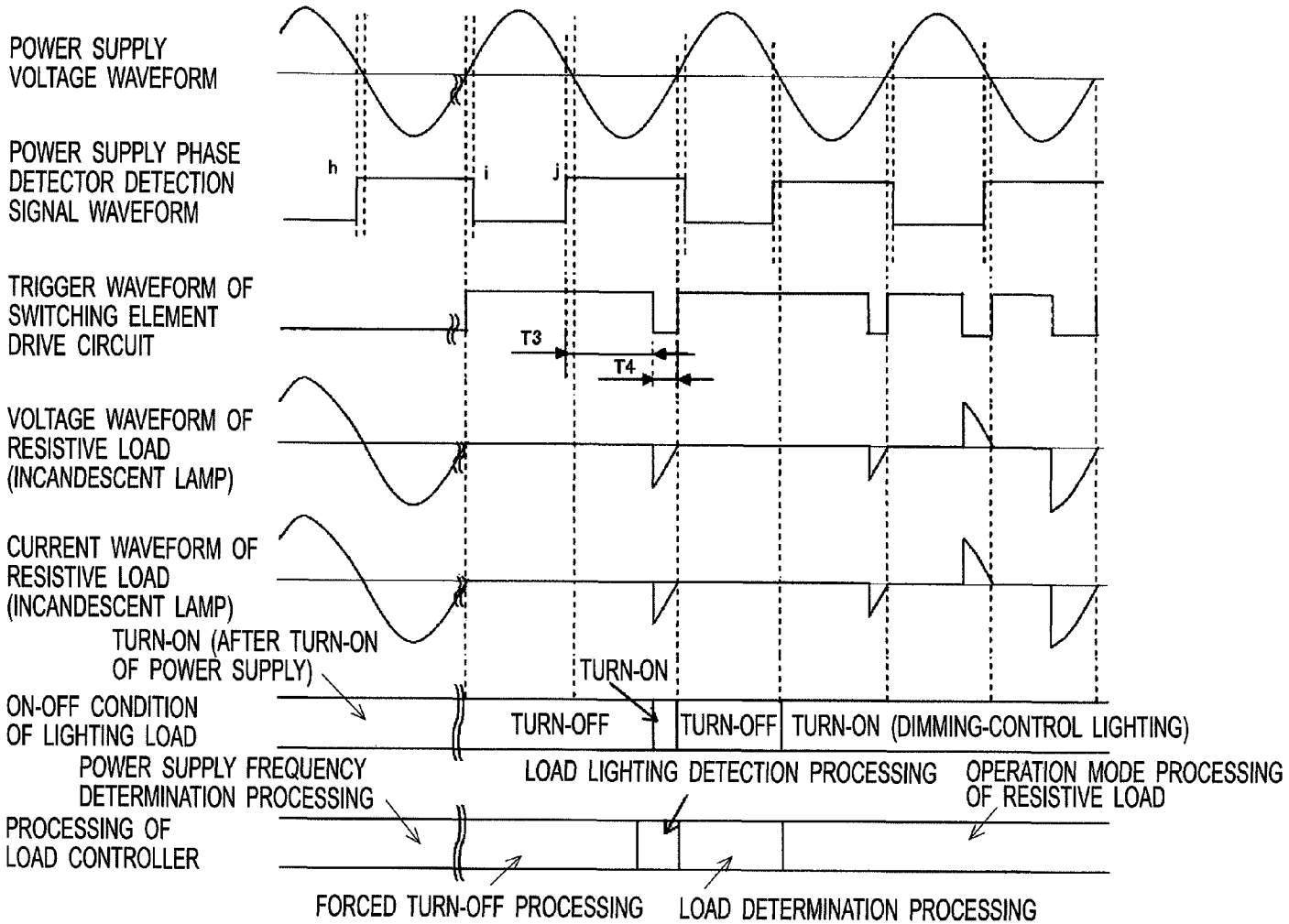
FIG. 22 is an operational waveform chart of the embodiment 5 of the present invention.

FIG. 21 is a flow chart illustrating an operation of the present embodiment, and FIG. 22 is an operational waveform. After turning on the power, the lighting device first reads a power supply phase signal from the power supply phase detector 4 into the load controller 5B. In this point, a time length between "h" and "i" or "i" and "j" in FIG. 22 has a value inherent to a power supply frequency. For example, if the power supply frequency is 50 Hz, the time length between "h" and "i" is addition of 10 ms and on-signal amounts of the transistor Q1 in FIG. 27. Thus, the power supply frequency is once determined, and also the lighting trigger signal of the lighting load 1 is once turned off.

Next, according to the information of the power supply frequency, the load controller 5B calculates so as to obtain a phase that is shifted by an arbitrary phase from the timing obtained by the power supply phase detector 4 and in which the capacitive load is not turned on (for example, approximately)135°. In this case, for example, the trigger signal is turned on during a period T4 from a point after a period T3 starting from a rising edge of the power supply phase signal (point "j" in FIG. 22) to the 180° phase. Concurrently, when the signal of the load lighting detector 8 is read and the load is confirmed to be turned on, the load is determined as a resistive load. Then, a dimming-control operation using a phase control is performed from the subsequent timing. The operational waveform in FIG. 22 is an example of this case.

When the lighting is not detected in this point, the load is assumed as a capacitive load. Then, the lighting signal is subsequently output from the 0° phase to the 180° phase.

As described above, the load lighting detector 8 determines whether the lighting load 1 is turned on by a predetermined phase control, followed by performing the lighting control according to each lighting operation. Accordingly, it is possible to automatically switch control operations depending on the types of the loads no matter what load is connected.

The embodiment has been set in view of the difference between the resistive load and the capacitive load. Meanwhile, a case of determining whether the load is the resistive load or the inductive load is similar, for example. Namely, by setting a phase in which the inductive load is not turned on, the respective operation modes can be switched depending on whether the load is turned on or not.

Figure 7:
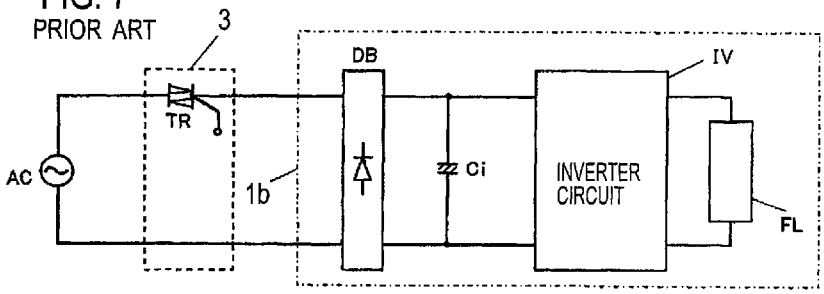
FIG. 7 PRIOR ART
FIG. 7 is a circuit diagram illustrating an internal constitution example of a conventional bulb-type fluorescent lamp as a capacitive load.
Figure 8:
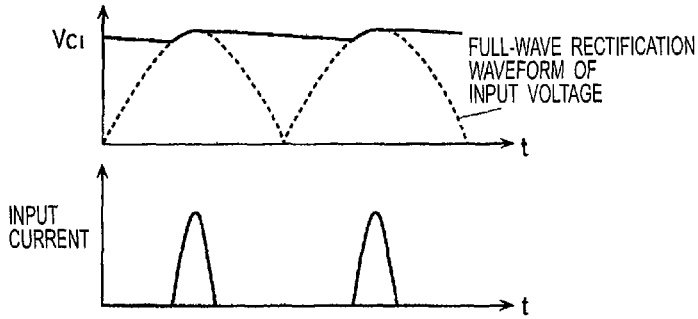
FIG. 8 PRIOR ART
FIG. 8 is a waveform chart illustrating an input current waveform of a conventional bulb-type fluorescent lamp.
Figure 9:
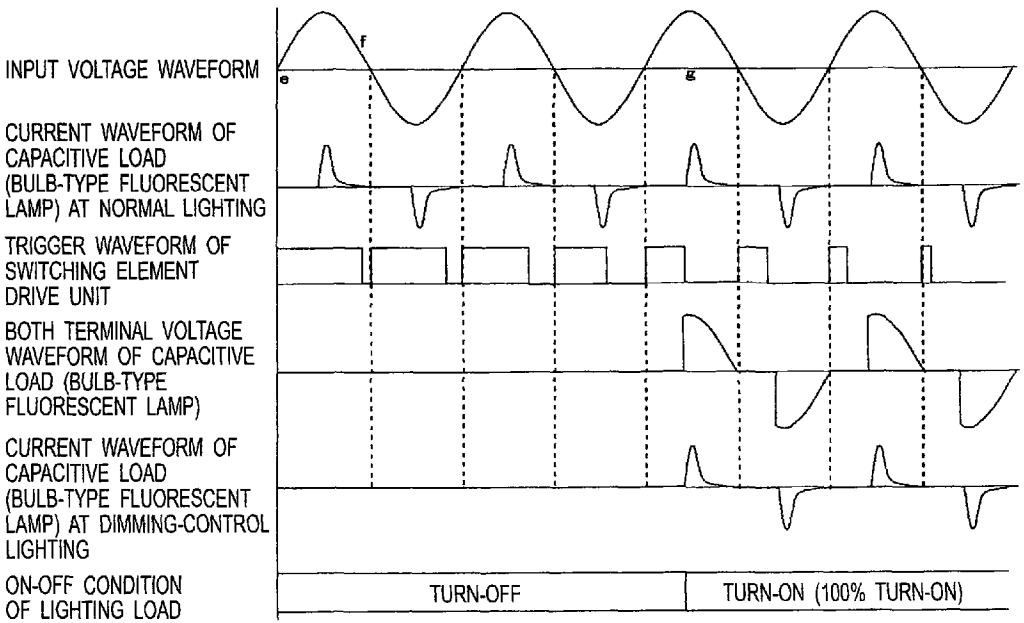
FIG. 9 PRIOR ART
FIG. 9 is a waveform chart illustrating an operation when connecting the bulb-type fluorescent lamp to the conventional lighting device of the dimming-control for an incandescent lamp.

When the lighting load is a capacitive load, the input current may vary depending on conditions in which the electrolytic capacitor Ci (in FIG. 7) of the input is charged or not charged. Therefore, for example, the load is intentionally turned on once when determining the power supply frequency as illustrated in FIG. 22, and the condition of the electrolytic capacitor Ci is preferably in a condition that the electrolytic capacitor Ci is charged similar to the normal lighting condition.

In addition, when the load lighting is delayed with respect to applying the voltage, the trigger signal at a predetermined phase when determining whether the load is turned on or not may be continuously applied repeatedly in certain cycles.

(Embodiment 6)

Figure 23:
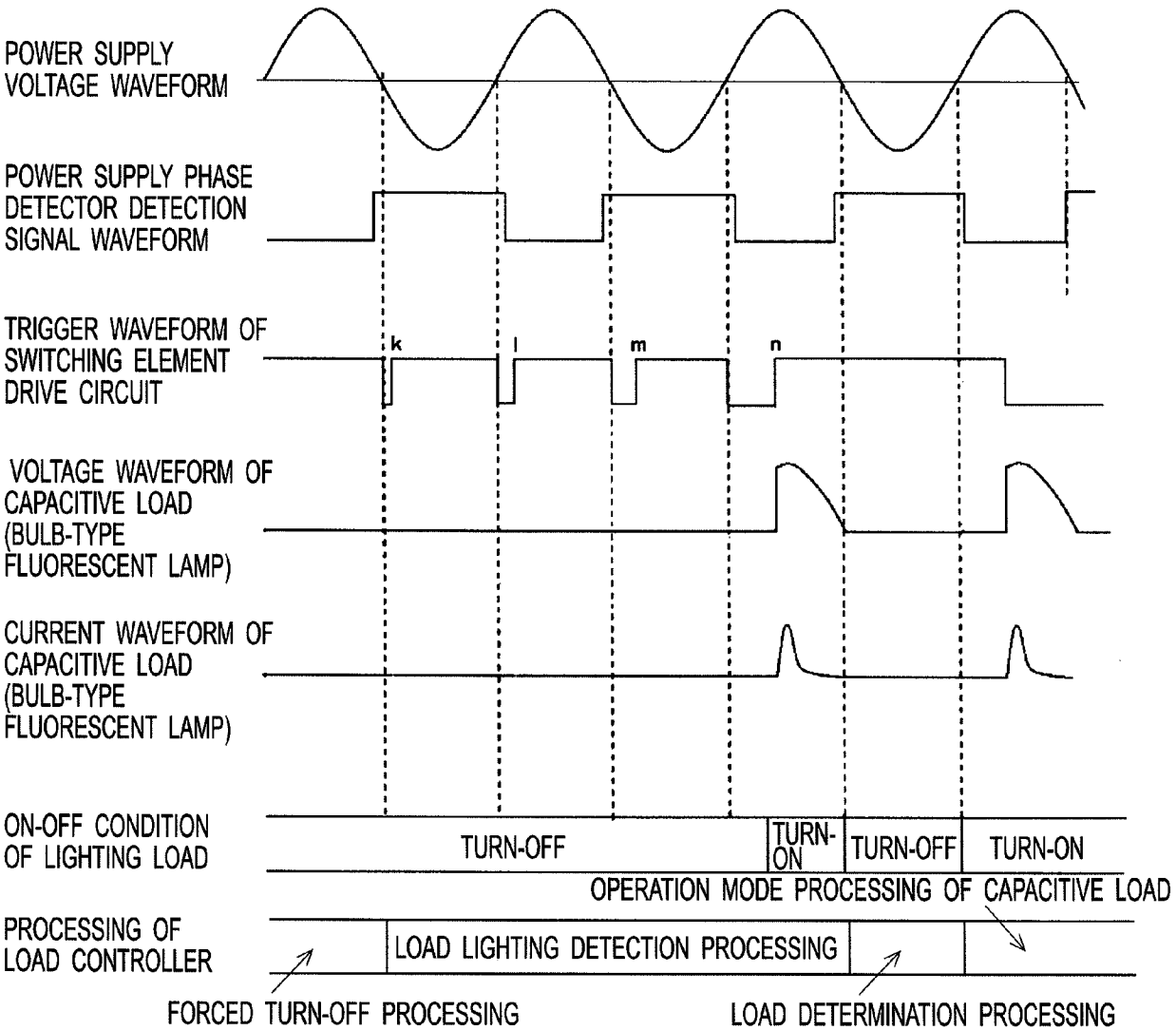
FIG. 23 is an operational waveform chart of an embodiment 6 of the present invention.
Figure 24:
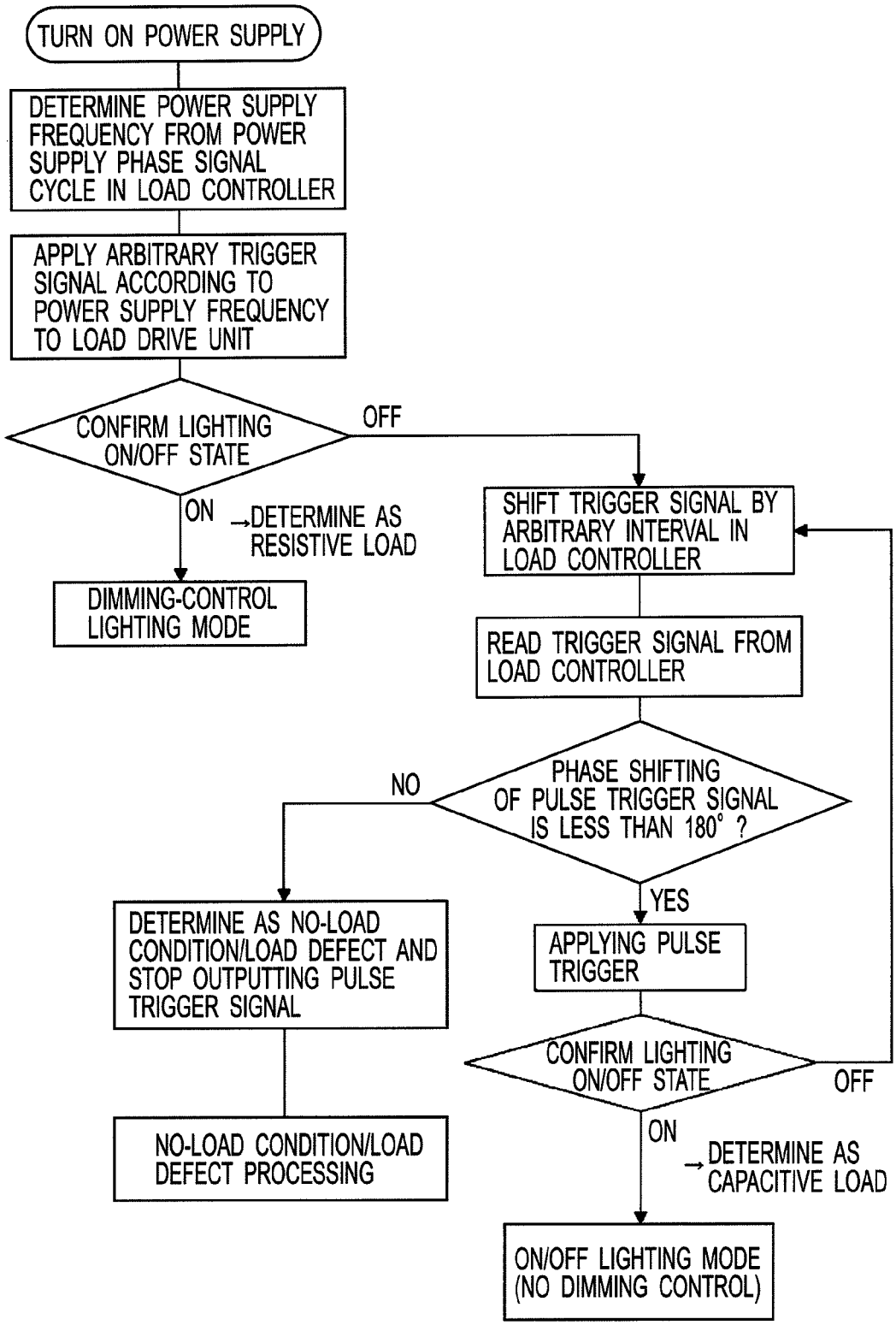
FIG. 24 is a flow chart illustrating an operation of the embodiment 6 of the present invention.

FIG. 23 illustrates a control operation of the present embodiment, and FIG. 24 illustrates a flow chart thereof. The fundamental operation is the same as the embodiment 5. The present embodiment is different from the embodiment 5 in a phase control method of the trigger signal at the load lighting detection.

The embodiment 5 determines whether the load is turned on or not at the fixed phase. In this case, for example, when the lighting load is not turned on because of any trouble (such as filament disconnection), the load controller 5B accidentally determines the lighting load as a bulb-type fluorescent lamp since the lighting load is not turned on even if it is an incandescent lamp. As a result, the load controller 5B keeps outputting the lighting signal.

On the other hand, a phase of the trigger signal is swept between the 0° phase and the 180° phase in this embodiment. With this configuration, when the load lighting is not detected even if the phase between 0° and 180° is swept, the lighting load is determined to be in a no-load condition or in a load anomaly condition. Then, for example, when determining the situation as a load anomaly, the lighting signal applied to the lighting load is stopped. As a result, a wasted electricity consumption can be cut and an unnecessary voltage application to the lighting load can be eliminated.

In FIG. 23, it is assumed that a trailing edge phase of the trigger signal (on-start timing) is fixed at around the 0° phase, and a rising edge phase (on-end timing) is a point "k". Then, only the rising edge phase is shifted to a point "l" in the next cycle. When the lighting is not detected, the rising edge phase is further shifted to a point "m", and subsequently a point "n".

When the lighting load is a resistive load, the lighting load is turned on at the first phase. Therefore, when the lighting is not detected, the lighting load can be simply determined as another load (such as capacitive load) or a load anomaly. Next, when the lighting load is turned on while the phase is gradually kept shifting, the lighting load then can be determined as a capacitive load. Further, when the lighting load is not turned on even at the 180° phase, the lighting load is determined as a load anomaly, thereby stopping the load output.

In addition, when the load lighting is delayed with respect to applying the voltage, the trigger signal at a predetermined phase may be continuously applied repeatedly in certain cycles and swept.

(Embodiment 7)

Figure 25:
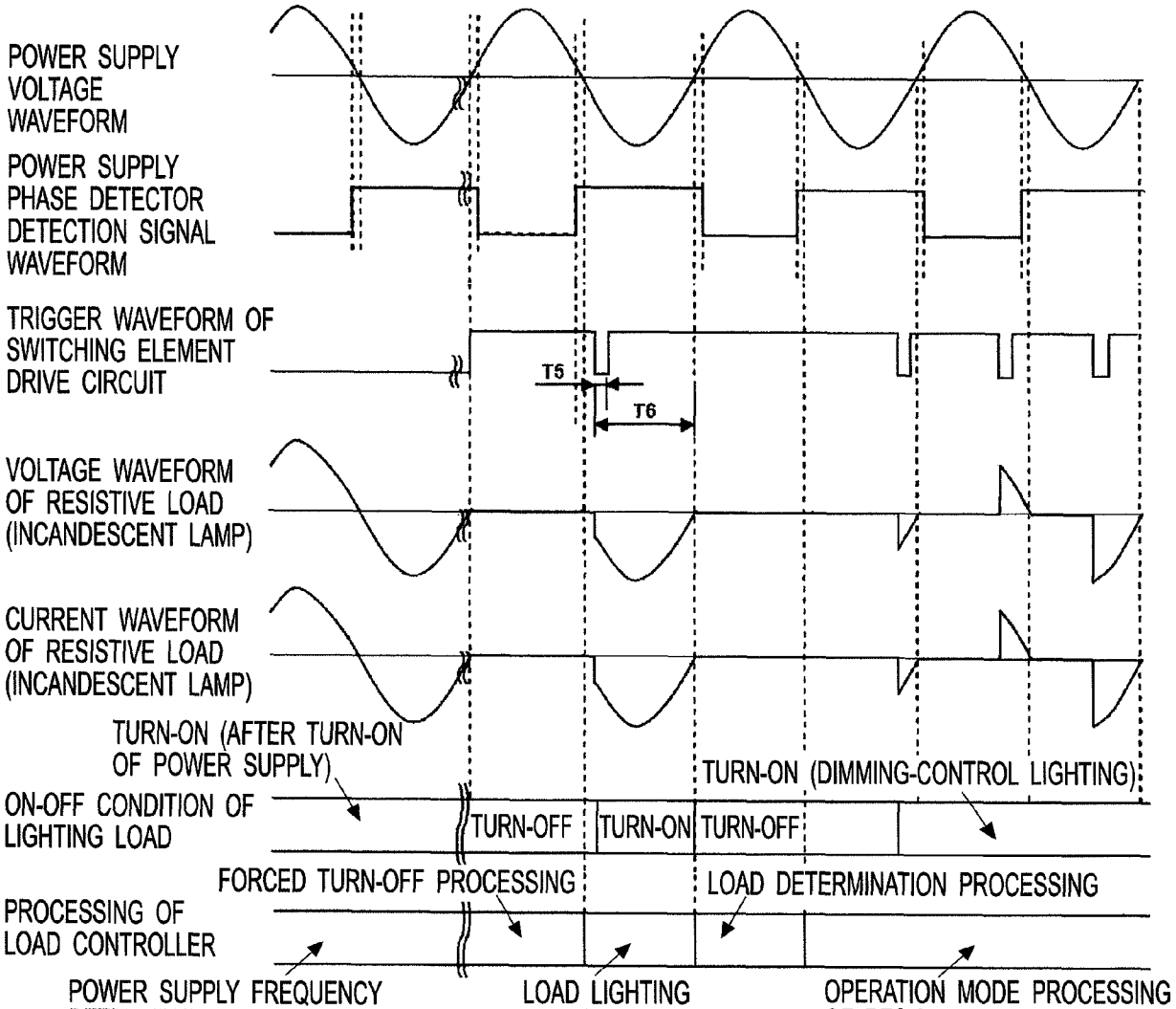
FIG. 25 is an operational waveform chart of an embodiment 7 of the present invention.

FIG. 25 illustrates a control operation of the present embodiment. The fundamental operation is the same as the embodiment 5. The present embodiment is different from the embodiment 5 in a control method of the trigger signal at the load lighting detection. A feature of the present embodiment is to use the TRIAC element TR in the switching element (refer to FIG. 27), so that the trigger signal can be a pulse signal with an arbitrary width. In an operation of the TRIAC element, when a gate signal of the TRIAC element is once turned on, the TRIAC element is kept turning on until the power supply voltage becomes zero as long as a current with more than a holding current value is applied to the TRIAC element even if the gate signal is turned off.

Therefore, even if the pulse width has a minimal width according to a property of the TRIAC element (such as approximately 300 μs), for example, the lighting load can be kept lighting. Thus, it is possible to suppress a gate current to a minimum level, thereby saving electricity.

In FIG. 25, the trigger signal with a width of T5 (such as 300 μs) is applied during a predetermined phase interval. When the lighting load is a resistive load (such as incandescent lamp), the TRIAC element is kept turning on during T6 as illustrated in the figure even after the trigger signal is turned off.

Furthermore, in a treatment after the load determination, the lighting load can be turned on by applying the minimal gate signal even if the lighting control is the same condition, due to the pulse trigger signal as illustrated in FIG. 25 (T5 of the pulse width).

(Embodiment 8)

Figure 26:
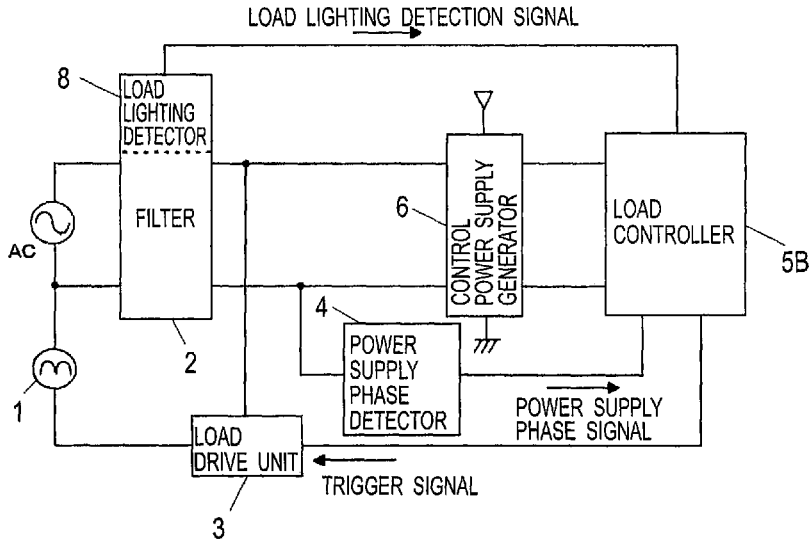
FIG. 26 is a block diagram illustrating a constitution of an embodiment 8 of the present invention.
Figure 27:
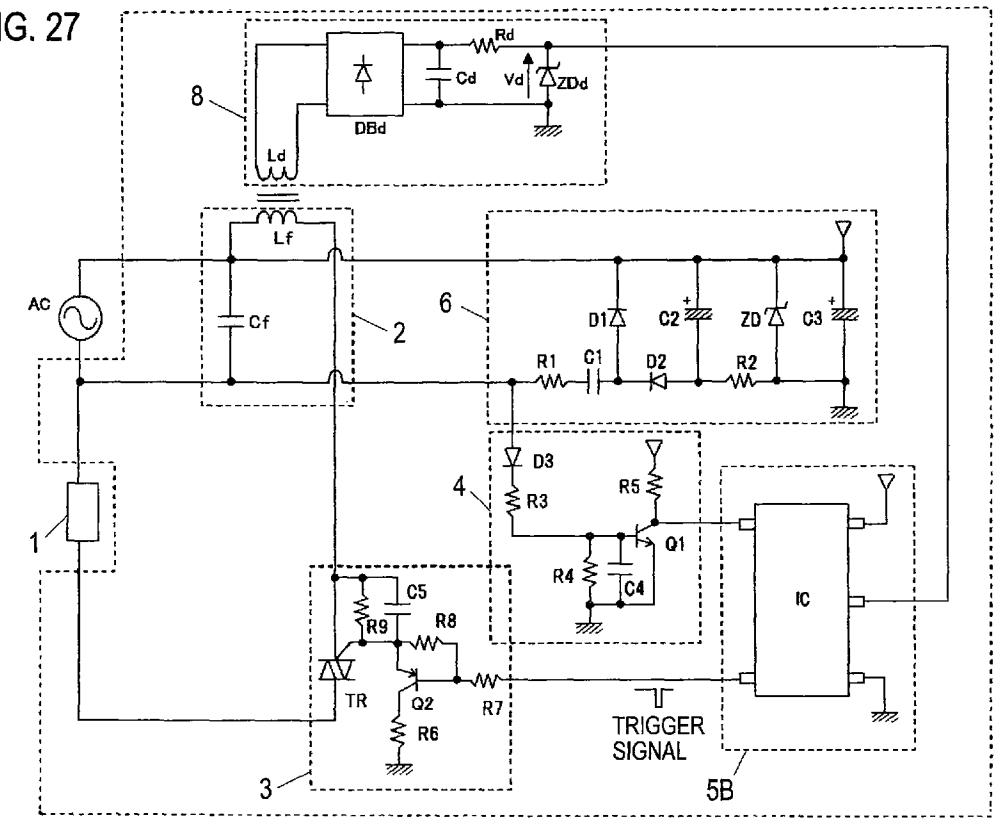
FIG. 27 is a circuit diagram illustrating a specific circuit constitution of the embodiment 8 of the present invention.

FIG. 26 illustrates a constitution diagram of the embodiment 8 of the present invention, and FIG. 27 illustrates a circuit diagram thereof. The fundamental constitution is the same as the embodiment 5. The difference in the present embodiment is a constitution of the load lighting detector 8, which determines whether the lighting load is turned on or not by a presence or absence of a current flowing in the filter 2.

The load lighting detector 8 of the present embodiment employs the filter 2 used for removing high-frequent noise generated at a dimming-control of the lighting load 1, as illustrated in FIG. 27. The filter 2 is a low-pass filter composed of a capacitor Cf and an inductor Lf, so as to detect whether the lighting load is turned on or not by use of an inductive voltage of the inductor Lf. Namely, the inductor Lf of the filter 2 is provided with a detection winding Ld having an electromagnetic coupling thereto, and a voltage generated in the detection winding Ld is rectified and smoothed by a diode bridge DBd and a capacitor Cd. Then, this voltage is clamped by a resistor Rd and a Zener diode ZDd. Thus, the voltage can be detected as a pulse waveform signal with a width of Td as illustrated in FIG. 28.

Figure 28:
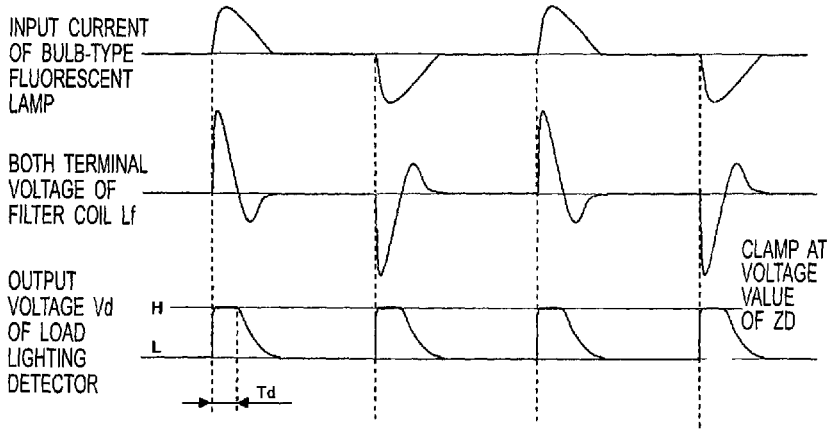
FIG. 28 is an operational waveform chart of the embodiment 8 of the present invention.

FIG. 28 is an example of a detection signal when the bulb-type fluorescent lamp as a capacitive load is turned on. When the load controller 5B determines a signal Vd as an H signal, the load controller 5B recognizes that the load is turned on. In this point, when the phase is a phase in which only the resistive load is turned on, the lighting load is determined as a resistive load. Moreover, when the trigger signal is swept as described in the embodiment 6, the load type is determined based on a relationship with a pulse phase of the trigger signal when the trigger signal is applied.

Next, a circuit constitution for each of portions in FIG. 27 will be explained. The following are similar explanations to the conventional example of FIG. 4.

The load drive unit 3 includes a TRIAC element TR inserted in the power feed path from the ac power supply AC to the lighting load 1, and a PNP-type transistor Q2 in which an emitter is connected to a gate of the TRIAC element TR and a collector is connected to the ground via a resistor R6. A base of the transistor Q2 is connected to the load controller 5B via a resistor R7, and connected to the emitter of the transistor Q2 via a resistor R8. In addition, a parallel circuit of a resistor R9 and a capacitor C5 is connected between one main electrode of the TRIAC element TR and the emitter of the transistor Q2.

The power supply phase detector 4 includes a rectifier diode D3 of which an anode is connected to the ac power supply AC, a NPN-type transistor Q1 of which a base is connected to a cathode of the rectifier diode D3 via a resistor R3, and a parallel circuit of a resistor R4 and a capacitor C4 connected between the base and the emitter of the transistor Q1. Namely, an output voltage of the ac power supply AC is rectified at the rectifier diode D3, divided by the resistors R3 and R4, smoothed at the capacitor C4, and input to the base of the transistor Q1. In addition, the collector of the transistor Q1 is connected to a dc power supply via a resistor R5, and a node of the resistor R5 and the transistor Q1 is connected to an IC of the load controller 5B. Thus, the output of the power supply phase detector 4 becomes an L-level by turning on the transistor Q1 when the output voltage of the ac power supply AC keeps above a predetermined voltage. Meanwhile, the output of the power supply phase detector 4 becomes an H-level by turning off the transistor Q1 when the input voltage falls below the predetermined voltage. Accordingly, the output is inverted at adjacent to the phase in which the voltage of the ac power supply AC becomes 0 V.

As illustrated in the conventional example of FIG. 5, the timing "a" in which the output of the power supply phase detector 4 is shifted from the L-level to the H-level is slightly earlier than the timing "b" of the phase in which the corresponding voltage becomes 0 V. In addition, the timing "c" in which the output is shifted from the H-level to the L-level is slightly later than the timing "d" of the phase in which the corresponding voltage becomes 0 V.

A control power supply generator 6 includes a first resistor R1 for inhibiting an incoming current, of which both terminals are connected to the ac power supply AC, a series circuit of a first capacitor C1 composed of e.g. a film capacitor and a first diode D1, a series circuit of a second diode D2 and a second capacitor C2 connected to the first diode D1 in parallel, a series circuit of a second resistor R2 and a Zener diode ZD connected to the second capacitor C2 in parallel, and a third capacitor C3 connected to the Zener diode ZD in parallel.

An anode of the first diode D1 is connected to the first capacitor C1 and a cathode of the first diode D1 is connected to the ac power supply AC. An anode of the second diode D2 is connected to the second capacitor C2 and a cathode of the second diode D2 is connected to a node of the first diode D1 and the first capacitor C1. An anode of the Zener diode ZD is connected to the second resistor R2 and a cathode of the Zener diode ZD is connected to the same side as the first diode D1 with respect to the ac power supply AC. Namely, a control power supply voltage is generated by a Zener voltage of the Zener diode ZD.

Note that, the circuit constitution of the load drive unit 3, the power supply phase detector 4, and the control power supply generator 6 is an example constitution. Obviously, the other circuit constitution having a similar function may be replaced.

(Embodiment 9)

Figure 29:
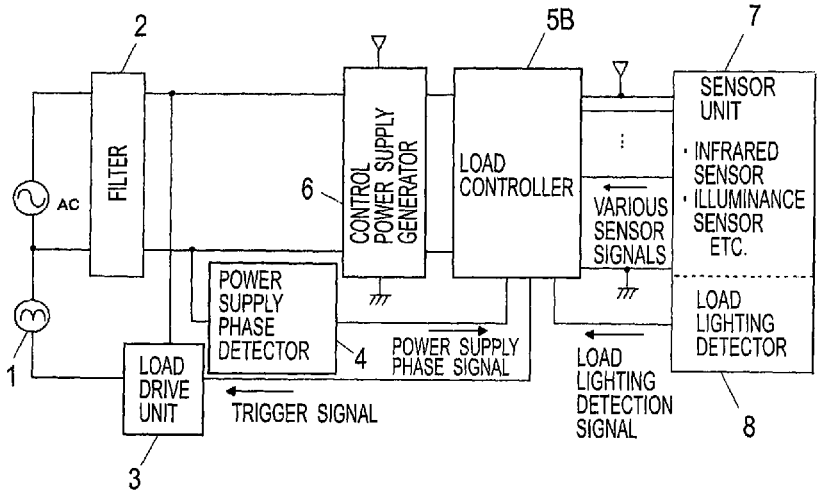
FIG. 29 is a block diagram illustrating a constitution of an embodiment 9 of the present invention.

FIG. 29 illustrates a constitution example of a lighting device of the present embodiment. In the present embodiment, the illuminance sensor of the sensor unit 7 concurrently functions as the load lighting detector 8. The load lighting detection is performed by the illuminance sensor in order to detect an illuminance change when the lighting load 1 is turned on, which is different from the embodiment 8.

Figure 30:
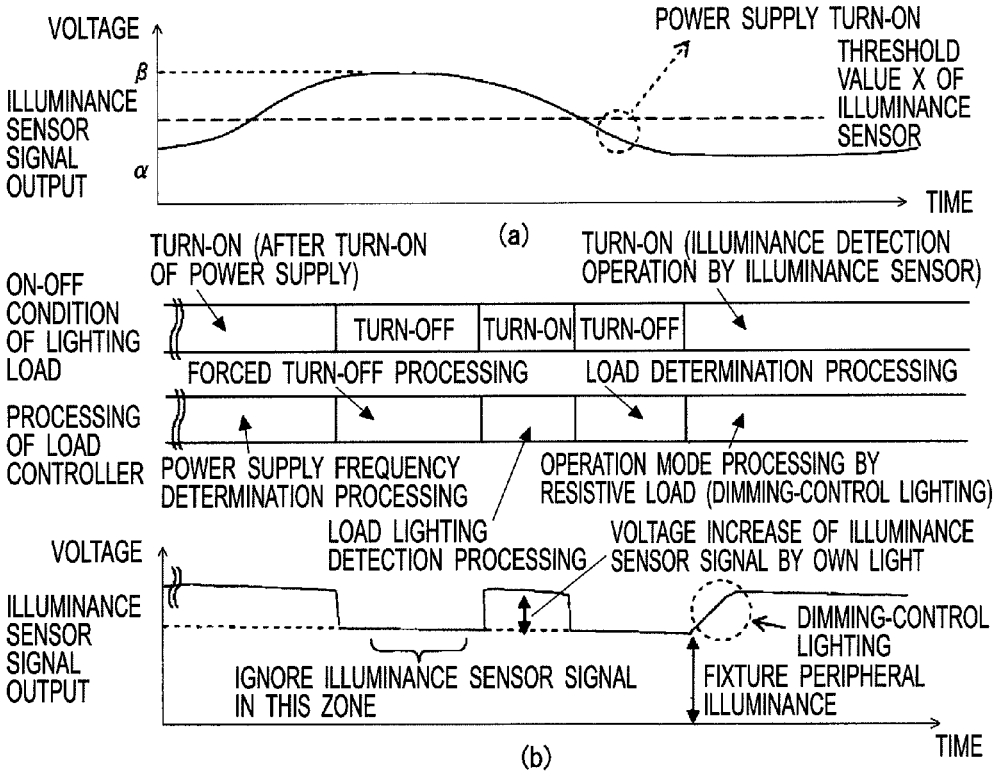
FIGS. 30 (*a*) and (*b*) are operational explanatory views of the embodiment 9 of the present invention.

The operation in this case will be explained with reference to FIG. 30. FIG. 30(*a*) illustrates a relationship between the signal of the illuminance sensor and the peripheral illuminance of the lighting fixture. An output signal waveform of the illuminance sensor continuously varies within an arbitrary range $\alpha$ to $\beta$ during a day. Then, by arbitrarily setting a threshold value X with respect to the illuminance sensor in the load controller 5B, it is possible to control the lighting load 1 by turning off the lighting load 1 when the signal level is above the threshold value X, and by turning on the lighting load 1 when the signal level falls below the threshold value X. For example, by setting the threshold value X to a signal level of nightfall in the illuminance sensor, the lighting load 1 can be automatically turned on at nightfall in every day. In the present embodiment, it is possible to determine whether the lighting load 1 is turned on or not by use of the illuminance sensor for the lighting control.

Next, the determination process of the lighting load and the subsequent operation after the lighting detection of the lighting load will be explained with reference to FIG. 30(*b*). For example, when the power supply is turned on when the signal level falls below the arbitrarily set threshold value X, the lighting device first determines the power supply frequency, followed by forcibly turning off the lighting load once. Next, according to the information of the power supply frequency, the trigger signal is applied at a phase that is shifted by an arbitrary phase from the timing obtained by the power supply phase detector 4 and in which the capacitive load is not turned on. When the lighting load 1 is lighted by applying the trigger signal at a predetermined phase, a detection illuminance of the illuminance sensor is rapidly increased. Then, the signal of the illuminance sensor is read. When a voltage elevation of the illuminance sensor signal by its own light is confirmed, the lighting load 1 is determined as a resistive load. Furthermore, the lighting load 1 is once turned off when the load detection process is completed, followed by performing the operation mode according to the type of the lighting load 1. The figure illustrates a case where the lighting load is determined as an incandescent lamp and turned on by the dimming-control.

In the present embodiment, the illuminance sensor concurrently functions as a lighting controller for controlling the lighting load according to the peripheral illuminance and as a sensor for the lighting confirmation to determine the type of the lighting load. After turning on the power supply, a result of the comparative determination of the threshold value X with the peripheral illuminance is not considered at least until the load lighting detection process is completed.

In addition, the signal level of the illuminance sensor may be increased by turning on the lighting load, and a phenomenon that the lighting load is turned off again (self turn-on/off phenomenon) may be occurred by exceeding the threshold value X. However, the self turn-on/off phenomenon by its own light may be prevented after the load determination by performing mask processing, e.g. removing an influence on the sensor signal caused by the lighting of the lighting load. For example, a step of subtracting an increased amount (increased amount due to its own light) of the signal level after turning on the lighting load with respect to the illuminance level before lighting so as to compare with the threshold value X is employed.

Figure 31:
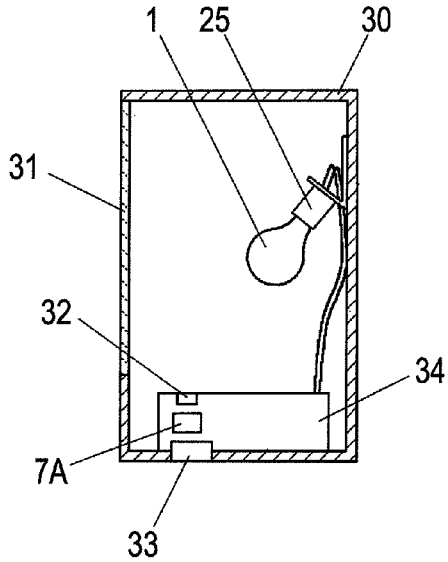
FIG. 31 is a cross-sectional view of a lighting fixture employing the embodiment 9 of the present invention.

FIG. 31 illustrates a constitution example of an actual lighting fixture. The lighting fixture is provided with the lighting load 1 and the lighting device 34 in a fixture housing 30 and a transparent glove 31 for transmitting light. Furthermore, an illuminance sensor 7A is equipped inside the lighting device 34. By providing a translucent window 32 located inside the lighting fixture in addition to a translucent window 33 provided in an outer flame of the fixture for transmitting peripheral light of the lighting fixture, the lighting fixture is configured to be able to detect light of the lighting load 1 itself.

Note that, the illuminance sensor 7A is composed of a photo IC diode, for example, and outputs a voltage signal with a higher voltage value as the periphery is brighter, as illustrated in FIG. 30(*a*).

(Embodiment 10)

A constitution example of a lighting device of the present embodiment is similar to the embodiment 9 (FIG. 29). An infrared sensor of the sensor unit 7 concurrently functions as the load lighting detector 8. The infrared sensor of the sensor unit 7 includes a pyroelectric sensor for detecting infrared radiated from a human body, for example. Based on an output of the pyroelectric sensor, the presence of a human body is detected. In addition, the lighting device determines whether the lighting load is turned on or not by detecting heat generated when the lighting load is turned on by use of the infrared sensor.

Figure 32:
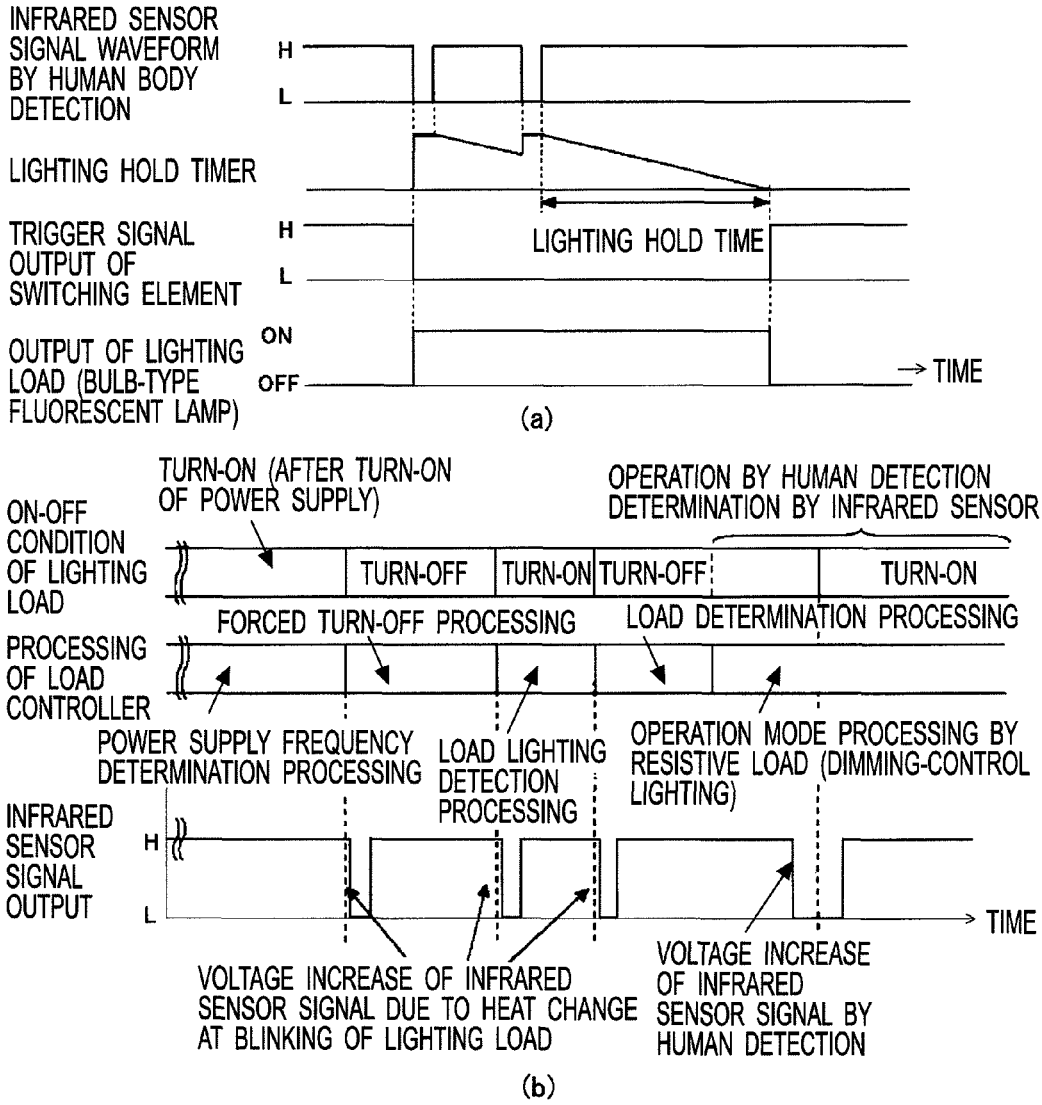
FIGS. 32(*a*) and (*b*) are operational explanatory views of an embodiment 10 of the present invention.

Operations of the present embodiment will be explained with reference to FIG. 32. FIG. 32(*a*) illustrates a lighting control operation of the lighting load using an infrared sensor signal. An output signal waveform is an L-level during detecting a human body. The load controller 5B connected with the infrared sensor outputs the trigger signal when detecting the L-level signal, thereby turning on the lighting load 1. In the figure, the lighting load 1 is configured to be turned on by the trigger signal with the L-level. Concurrently, a lighting hold timer starts counting. Then, the trigger signal is set to the H-level again at the point when the timer finishes counting after an arbitrary period, thereby turning off the lighting load 1. When a signal that a human body is detected again is input during the count of the lighting hold timer, the lighting hold timer is configured to restart counting from the point. In the present embodiment, the lighting detection of the lighting load 1 is performed by use of the infrared sensor for the lighting control by detecting the human body as described above.

Next, the determination process of the lighting load and the subsequent operation after the lighting detection of the lighting load will be explained with reference to FIG. 32(*b*). As illustrated in the figure, a signal output of the infrared sensor is switched according to changes of heat generated from a filament of the lighting load when the lighting load 1 is turned on or turned off.

After turning on the power supply, the output of the infrared sensor is ignored until the load lighting detection process is started. When the trigger signal at a predetermined phase is applied after starting the lighting detection process, and at the same time, when an output change is detected by observing the signal of the infrared sensor, the lighting load is determined to be turned on. Furthermore, the lighting load is once turned off under a condition that the output of the infrared sensor is ignored when the load determination process is completed, followed by determining the human detection by the infrared sensor and performing the operation mode according to the type of the lighting load.

In order to prevent the output of the infrared sensor from being occurred due to the blinking of the lighting load so as not to accidentally determine that a human body is detected, mask processing, e.g. ignoring the signal of the infrared sensor, is performed until the lighting load is confirmed to be turned on after completely turning off, thereby preventing the detection determination from being improperly operated because of its own light.

Figure 33:
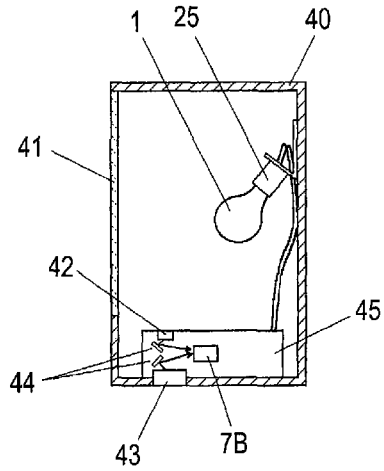
FIG. 33 is a cross-sectional view of a lighting fixture employing the embodiment 10 of the present invention.

FIG. 33 illustrates a constitution example of an actual lighting fixture. The lighting fixture is provided with the lighting load 1 and a lighting device 45 in a fixture housing 40 and a transparent glove 41 for transmitting light. Furthermore, an infrared sensor 7B is equipped inside the lighting device 45. By providing a condensing lens 42 located inside the lighting fixture in addition to a condensing lens 43 provided in an outer flame of the fixture for detecting a human in a periphery of the lighting fixture, and by using reflective plates 44 for collecting light in the infrared sensor 7B from each lens, the lighting fixture is configured to be able to detect heat changes when the lighting load 1 is turned on.

(Embodiment 11)

In the present embodiment, the load controller 5B is configured to continuously observe the load lighting condition after the operation mode is determined by the load lighting detection process. After determining the load, when the lighting load is not turned on although the trigger signal is applied at a phase in which the lighting load should be turned on, or when the lighting load is turned on at a phase in which the lighting load is not usually turned on, the lighting load is determined as a load anomaly. Then, the output of the trigger signal for lighting is once stopped, followed by repeating the load determination process at turning on the power supply. By adding such functions, the lighting device itself can automatically respond to situations where a user replaces the lighting load while being applied electricity or the lighting load is broken.

(Embodiment 12)

Figure 34:
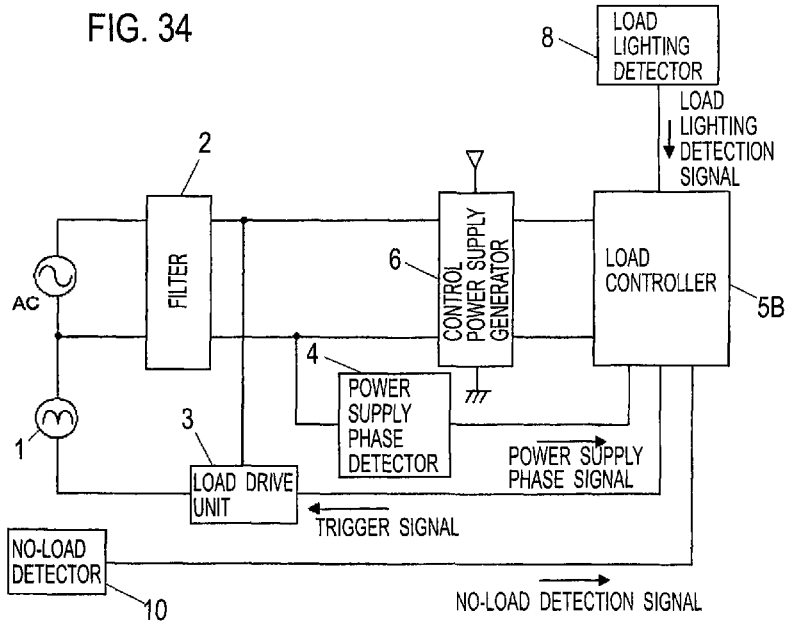
FIG. 34 is a block diagram illustrating a constitution of an embodiment 12 of the present invention.

FIG. 34 illustrates a constitution diagram of the present embodiment. The present embodiment is provided with a no-load detector 10 in addition to the load lighting detector 8. A signal of the no-load detector 10 is constantly monitored by the load controller 5B after turning on the power supply. The no-load detector 10 includes a mechanical switch, which is provided in a socket and connected to the load controller 5B.

When a no-load detection signal is output from the no-load detector 10 after the operation mode is determined by the load lighting detection process, the load controller 5B determines that the lighting load is removed, and stops outputting the trigger signal for lighting, followed by repeating the load determination process at turning on the power supply. By adding such functions, the lighting device itself can automatically respond to a situation where a user replaces the lighting load while being applied electricity. In addition, when determining no load, it is possible to save electricity by clearing an unnecessary signal to be output to the switching element.

(Embodiment 13)

Figure 35:
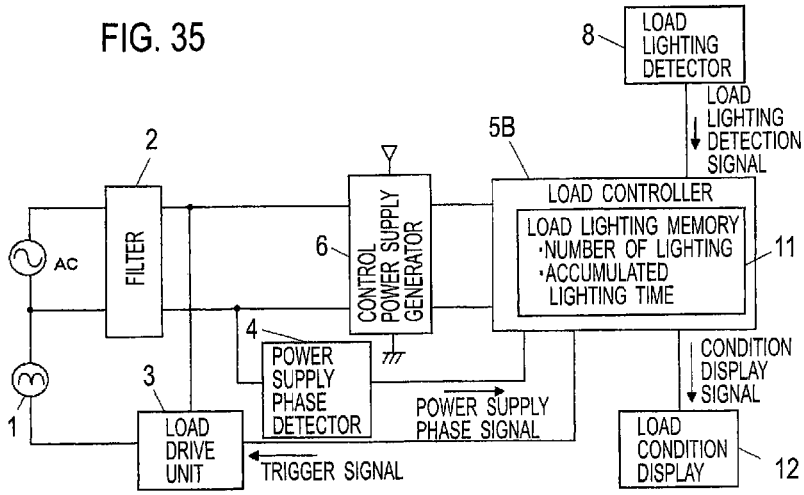
FIG. 35 is a block diagram illustrating a constitution of an embodiment 13 of the present invention.

FIG. 35 illustrates a constitution diagram of the present embodiment. The present embodiment is provided with a load lighting memory 11 for storing a number of lighting and an accumulated time of lighting in the load controller 5B, and provided with a load condition display 12, in addition to the load lighting detector 8. The detection signal of the load lighting detector 8 is constantly monitored by the load controller 5B similar to the embodiment 11.

The load lighting memory 11 provided in the load controller 5B stores a number of rising edges or trailing edges of the lighting detection signal of the load lighting detector 8. In addition, the load lighting memory 11 calculates a lighting time by a product of the number of the rising or trailing edges and a period of the power supply frequency obtained from the power supply phase signal, thereby storing the lighting time as an accumulated lighting time. When the stored number reaches an arbitrary value to be set in the determined lighting load, the load lighting memory 11 sends the signal to the load condition display 12, so as to inform a user of the current condition. By adding such functions, it is possible to inform a user of the current condition with some sound according to the lighting operation when the remaining number of the blinking of the bulb-type fluorescent lamp reaches 1,000 when it is assumed that the blinking performance is limited to 30,000 times.

The lighting fixture used, e.g. at a front door, is mostly the only light supply at the periphery thereof. Therefore, by preventing troubles such as a sudden turnoff during night and avoiding a burnt-out lamp, it is possible to enhance convenience for a user so as to maintain security (Embodiment 14)

Figure 36:
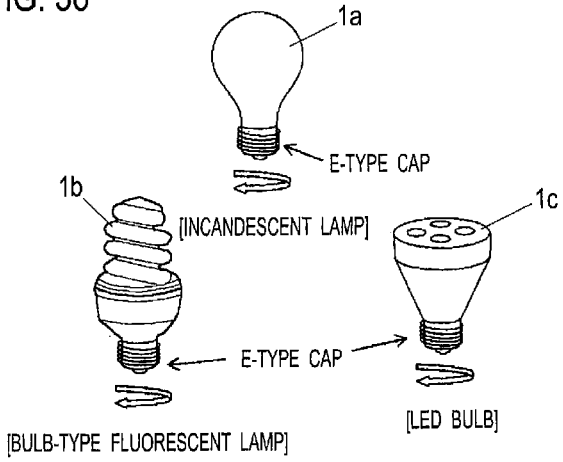
FIG. 36 is a perspective view illustrating a configuration of each of lighting loads having an E-type cap used in an embodiment 14 of the present invention.

The present embodiment is described with reference to FIG. 36. The reference numeral 1*a* is an incandescent lamp, 1*b* is a bulb-type fluorescent lamp, and 1*c* is an LED bulb. It can be considered that the lighting loads include various combinations of the types, such as a combination of the incandescent lamp and the LED lamp when the lighting load is a resistive load, and a combination of the bulb-type fluorescent lamp and the LED lamp when the lighting load is a capacitive load. In addition, a bayonet cap also varies when the lighting load is the fluorescent lamp and the LED lamp.

In this embodiment, the lighting device in the embodiments 1 to 13 is configured to combine with a socket of an E-type cap. By using the socket of the E-type cap, configurations of the lighting loads should have an approximately spherical shape or an approximately cylindrical shape as illustrated in FIG. 36 in view of a fixing matter, and should have a diameter that is easily handled by people. Therefore, dimensions of the lighting loads are consequently to be similar. Thus, a cover of the lighting load, for example, can have the same dimension easily designed and able to place every load, even in the different lighting loads, without being affected largely by designs of each load.

Industrial Applicability

According to the present invention, it is possible to prevent troubles such as a flicker and a lighting delay caused by a property difference of the lighting load. Therefore, it is possible to provide the lighting device without being affected by the load property difference. Thus, a user can freely select a lighting load without intentionally setting a certain lighting load.

The invention claimed is:

1. A lighting device, comprising:

a switching element for turning on/off a commercial power supply supplied as a power supply for a lighting load, a power supply phase detector for detecting a phase of the commercial power supply so as to perform a phase control for the lighting load;

a load controller for determining a conduction angle of the switching element by receiving an output of the power supply phase detector, in which a signal to be output at an arbitrary conduction angle to the switching element from the load controller performs a lighting control for the lighting load; and a load lighting detector for detecting whether the lighting load is turned on or not;

wherein the load controller comprises a determination unit for determining a type of the lighting load by a signal from the load lighting detector, wherein the load controller switches operation modes depending on the type of the lighting load according to a result determined by the determination unit during a predetermined period after turning on the power supply.

2. The lighting device of claim 1, wherein the determination unit turns on the switching element at a phase of a conduction angle of the commercial power supply in which the lighting load is turned on during the predetermined period after turning on the power supply so as to determine the type of the lighting load during the predetermined period, and the load controller switches operation modes depending on the type of the lighting load determined by the load determination unit.

3. The lighting device of claim 2, wherein the load determination unit determines the type of the lighting load by comparing signal levels of detection signals obtained from a load current detector detecting a current flowing in the lighting load and a load voltage detector detecting a voltage applied to the lighting load.

4. The lighting device of claim 3, wherein the load current detector detects an inductive voltage of a secondary winding provided at an inductor of a high-frequency filter connected in series between the lighting load and the commercial power supply.

5. The lighting device of claim 2, wherein the determination unit determines the lighting load by comparing illuminance levels of each wavelength obtained by an illuminance sensor including a plurality of optical filters selectively transmitting light with different wavelength ranges.

6. The lighting device of claim 5, wherein the determination unit determines the type of the lighting load by using the illuminance sensor for controlling an on-off action of the lighting load according to a peripheral illuminance.

7. The lighting device of claim 1, wherein the load controller turns on the switching element at the phase of the conduction angle of the commercial power supply in which only an arbitrary lighting load is turned on during the predetermined period after turning on the power supply, so as to switch operation modes depending on the type of the lighting load according to a result determined during the predetermined period.

8. The lighting device of claim 7, wherein a signal to be output at an arbitrary conduction angle from the load controller to the switching element is swept in a range between a phase angle 0° at which the commercial power supply raises up from 0 V and a phase angle 180°, in which the lighting load is turned on.

9. The lighting device of claim 7, wherein the switching element is a TRIAC element, and the signal to be output at an arbitrary conduction angle from the load controller to the switching element has a pulse waveform fixed with an arbitrary width.

10. The lighting device of claim 7, wherein the load lighting detector detects whether the lighting load is turned on or not by a current value of an inductance element of a high-frequency filter connected in series between the lighting load and the commercial power supply.

11. The lighting device of claim 7 , further comprising an illuminance sensor for detecting a periphery illuminance, wherein the load controller includes a function to perform a lighting control of the lighting load by the switching element depending on the periphery illuminance detected by the illuminance sensor, and the load lighting detector detects whether the lighting load is turned on or not by detecting an output change of a visible light emitted from the lighting load by the illuminance sensor.

12. The lighting device of claim 7, further comprising an infrared sensor for detecting a human, wherein the load controller includes a function to perform a lighting control of the lighting load by the switching element when determining that a human is detected, and the load lighting detector detects whether the lighting load is turned on or not by detecting an output change of an infrared amount emitted from the lighting load by the infrared sensor.

13. The lighting device of claim 7, wherein when an output of the load lighting detector is determined to be in a different condition from an on-off condition of the lighting load in a lighting operation mode while constantly confirming a signal from the load lighting detector under a condition that an operation mode is determined, a transmission of an lighting signal is stopped so as to redetermine the type of the lighting load.

14. The lighting device of claim 7, further comprising a no-load detector for detecting the lighting load to be in a no-load condition while the power supply is on, wherein when the no-load condition is detected, the transmission of the lighting signal is stopped so as to redetermine the type of the lighting load at a point when the load is detected.

15. The lighting device of claim 7, further comprising a memory that records either a number of lighting times of the lighting load obtained by a signal count of the load lighting detector or a total lighting time of the lighting load obtained by an integrated length of all signals from the load lighting detector, or both, wherein the lighting device performs a desired operation when a recorded value reaches an arbitrarily set value depending on the type of the lighting load determined preliminarily.

16. The lighting device of claim 7, wherein the lighting device performs a dimming-control operation when the lighting load is determined as an incandescent lamp, and performs an on-off operation when the lighting load is determined as a fluorescent lamp.

17. The lighting device of claim 7, wherein when the lighting load is used for a lighting fixture to perform a warning operation by blinking the lighting load, the lighting load is automatically controlled by the load controller so as to reduce a blinking frequency of the lighting load when the lighting load is determined as a fluorescent lamp.

18. A lighting fixture, comprising the lighting device of claim 1, and a socket of an E-type cap for the lighting load.

* * * * *

UNITED STATES PATENT AND TRADEMARK OFFICE

CERTIFICATE OF CORRECTION

PATENT NO. : 8,310,166 B2
APPLICATION NO. : 12/742688
DATED : November 13, 2012
INVENTOR(S) : Shinichi Nagaoka It is certified that error appears in the above-identified patent and that said Letters Patent is hereby corrected as shown below:

In the Claims

Column 18, line 57 (claim 3) the term "load" should be deleted.

Signed and Sealed this
Second Day of July, 2013

Teresa Stanek Rea
*Acting Director of the United States Patent and Trademark Office*